US011282461B2

(12) United States Patent
Li et al.

(10) Patent No.: US 11,282,461 B2
(45) Date of Patent: Mar. 22, 2022

(54) DISPLAY PANEL, DRIVING METHOD THEREOF AND DISPLAY DEVICE

(71) Applicant: Xiamen Tianma Micro-Electronics Co., Ltd., Xiamen (CN)

(72) Inventors: Jieliang Li, Xiamen (CN); Yong Yuan, Shanghai (CN); Wanming Huang, Xiamen (CN)

(73) Assignee: Xiamen Tianma Micro-Electronic Co., Ltd., Xiamen (CN)

( * ) Notice: Subject to any disclaimer, the term of this patent is extended or adjusted under 35 U.S.C. 154(b) by 0 days.

(21) Appl. No.: 17/017,587

(22) Filed: Sep. 10, 2020

(65) Prior Publication Data

US 2021/0407419 A1 Dec. 30, 2021

(30) Foreign Application Priority Data

Jun. 30, 2020 (CN) ..... 202010622498.0

(51) Int. Cl.
*G09G 3/3258* (2016.01)
*G09G 3/3233* (2016.01)
*G09G 3/3266* (2016.01)

(52) U.S. Cl.
CPC ..... *G09G 3/3258* (2013.01); *G09G 3/3233* (2013.01); *G09G 3/3266* (2013.01); *G09G 2320/0247* (2013.01); *G09G 2330/023* (2013.01)

(58) Field of Classification Search
CPC .. G09G 3/3258; G09G 3/3233; G09G 3/3266; G09G 2320/0247; G09G 2330/023
See application file for complete search history.

(56) References Cited

U.S. PATENT DOCUMENTS

2013/0335391 A1* 12/2013 Kim ..... G09G 3/3291 345/211
2017/0061875 A1 3/2017 Cho et al.
2020/0226978 A1* 7/2020 Lin ..... H01L 27/3262

FOREIGN PATENT DOCUMENTS

CN 108878494 A 11/2018
KR 20200034086 A 3/2020

* cited by examiner

*Primary Examiner* — Stacy Khoo
(74) *Attorney, Agent, or Firm* — Alston & Bird LLP

(57) ABSTRACT

A display device includes a pixel driving circuit and a light-emitting element. The pixel driving circuit includes an initialization signal terminal, a data signal terminal, a first initialization unit, a driving module and a first light-emitting control unit. The first initialization unit is electrically connected between the initialization signal terminal and an anode of the light-emitting element. In a write frame, the first initialization unit is configured to, under control of a first scan signal, provide the anode of the light-emitting element with a first initialization voltage signal Vref1. In a maintenance frame, the first initialization unit is configured to, under the control of the first scan signal, provide the anode of the light-emitting element with a second initialization voltage signal Vref2 which is different from the first initialization voltage signal Vref1.

18 Claims, 21 Drawing Sheets

DISPLAY PANEL, DRIVING METHOD THEREOF AND DISPLAY DEVICE

This application claims priority to Chinese patent application No. CN202010622498.0 filed on Jun. 30, 2020, the content of which is incorporated herein by reference in its entirety.

TECHNICAL FIELD

Embodiments of the present application relate to the field of display technologies and, in particular, to a display panel and a driving method thereof, and a display device.

BACKGROUND

With the development of display technologies, an organic light-emitting diode display panel has become the mainstream display panel due to its low power consumption and fast response speed, and has been widely applied to electronic devices such as mobile phones, laptops, and computers.

How to reduce the power consumption has always been a major research focus in the field of display. Various ways to reduce the power consumption arise where the way of reducing the driving frequency has a significant effect in reducing power consumption. The display panel includes a normal driving mode and a low-frequency driving mode. When displaying a dynamic picture, the display panel may adopt the normal driving mode. In this case, the driving frequency is relatively high, for example, 60 HZ, and each frame is a write frame in which a data represented by voltage is applied into a sub-pixel. When displaying a static picture, the display panel may adopt the low-frequency driving mode. In this case, the driving frequency is relatively low, for example, 1 HZ, and one frame of write frames and 59 frames of maintenance frames are included within 1 s. The difference between the maintenance frame and the write frame is that in the maintenance frame, a data voltage previously written into the write frame is maintained and a new data voltage is not written into the sub-pixel. In this way, the effect of reducing the power consumption is achieved.

However, due to the difference between the maintenance frame and the write frame, there is a brightness difference between the write frame and the maintenance frame, which results in a flicker observed by the user.

SUMMARY

The present application provides a display panel and a driving method thereof, and a display device, so as to reduce the brightness difference between the write frame and the maintenance frame and improve the issue of the flicker.

In the first aspect, an embodiment of the present application provides a display panel. The display panel includes a pixel driving circuit and a light-emitting element. The pixel driving circuit includes an initialization signal terminal, a data signal terminal, a first initialization unit, a driving module and a first light-emitting control unit.

The first initialization unit is electrically connected between the initialization signal terminal and an anode of the light-emitting element. In a write frame, the first initialization unit is configured to, under the control of a first scan signal, provide the anode of the light-emitting element with a first initialization voltage signal Vref1. In a maintenance frame, the first initialization unit is configured to, under the control of the first scan signal, provide the anode of the light-emitting element with a second initialization voltage signal Vref2 which is different from the first initialization voltage signal Vref1.

The driving module and a first terminal of the first light-emitting control unit are electrically connected to a first node, and a second terminal of the first light-emitting control unit is electrically connected to the anode of the light-emitting element. In the write frame and the maintenance frame, the first light-emitting control unit is configured to, under the control of a light-emitting control signal, control a driving current generated by the driving module to flow into the light-emitting element.

A time period corresponding to a valid pulse of the first scan signal is within a time period corresponding to an invalid pulse of the light-emitting control signal. In the write frame, the driving module is configured to receive a data voltage signal provided by the data signal terminal, and in the maintenance frame, the driving module is configured to do not receive the data voltage signal.

In the second aspect, an embodiment of the present application further provides a display device. The display device includes the display panel described in the first aspect.

In the third aspect, an embodiment of the present application further provides a driving method of a display panel. The driving method is applicable to the display panel described in the first aspect and includes steps described below.

In the write frame, the first initialization unit, under the control of the first scan signal, provides the anode of the light-emitting element with the first initialization voltage signal Vref1; and in the maintenance frame, the first initialization unit, under the control of the first scan signal, provides the anode of the light-emitting element with the second initialization voltage signal Vref2.

In the write frame and the maintenance frame, the driving module generates a driving current according to the data voltage signal; and the first light-emitting control unit, under the control of the light-emitting control signal, controls the driving current to flow into the light-emitting element to drive the light-emitting element to emit light.

DETAILED DESCRIPTION

Figure 1:
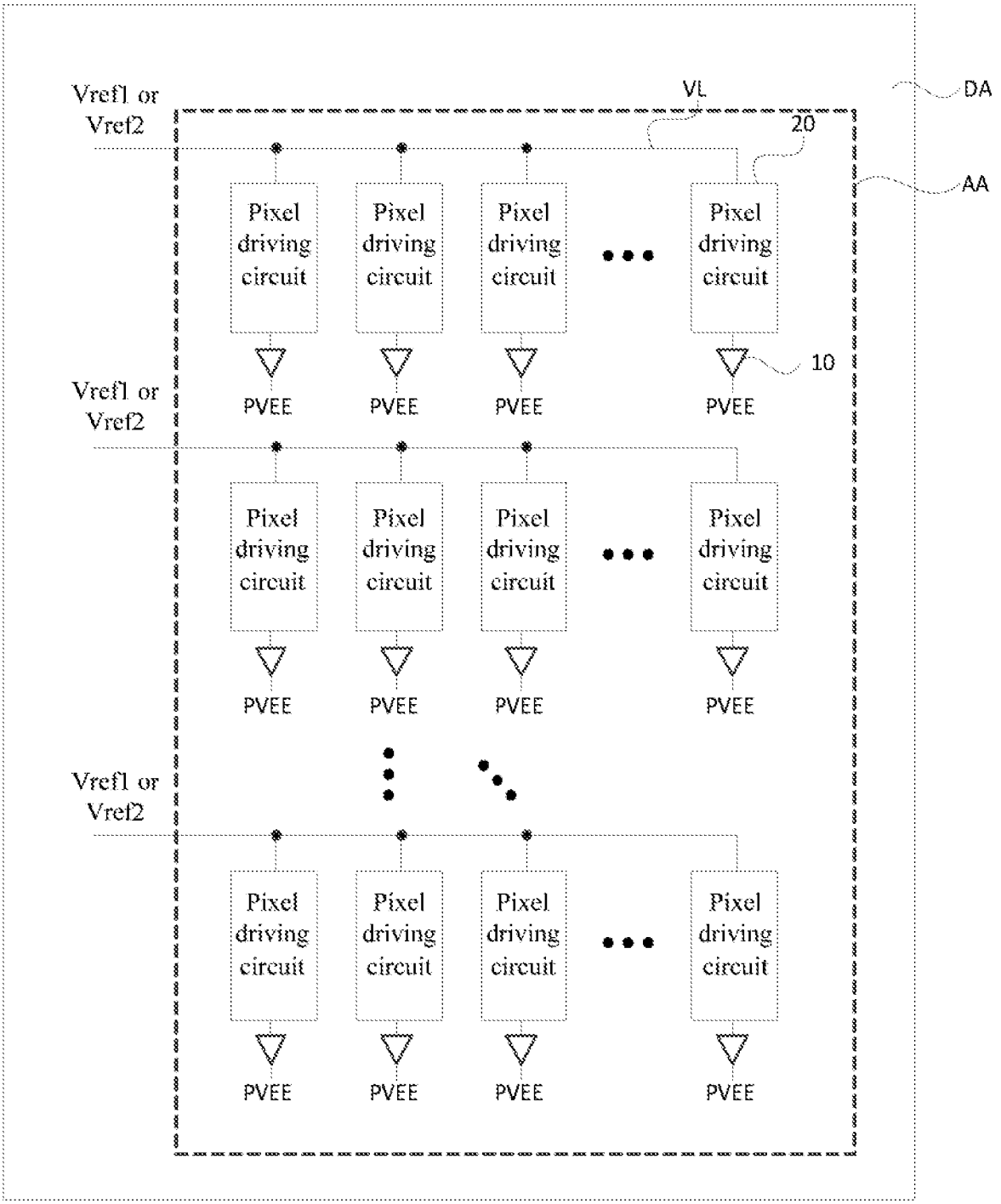
FIG. 1 is a schematic diagram of a display panel according to an embodiment of the present application.

The present application will be further described in detail hereinafter in conjunction with the drawings and embodiments. It is understood that the specific embodiments set forth herein are merely intended to illustrate the present application and not to limit the present application. Additionally, it is also understood that for ease of description, merely part, not all, of the structures of the present application are illustrated in the drawings.

It is found that reasons why there is the brightness difference between the write frame and the maintenance frame are as follows. The pixel driving circuit includes a driving module, a first light-emitting control unit and a first initialization unit, the driving module and a first terminal of the first light-emitting control unit are electrically connected to a first node, and a second terminal of the first light-emitting control unit and the first initialization unit are electrically connected to an anode of a light-emitting element. Since there is a difference between the write frame and the maintenance frame, where the difference is whether a data voltage signal is written into, the voltage of the first node is different at the initial light-emitting moment of the write frame and the initial light-emitting moment of the maintenance frame, such that the time required for the voltage of the first node to become the gray-level voltage is different. Therefore, finally, in the write frame and the maintenance frame, the total time for the voltage of the first node to become the gray-level voltage and the total time for the voltage of the anode of the light-emitting element to become the gray-level voltage are different, resulting in the brightness difference between the write frame and the maintenance frame.

In view of the above, an embodiment of the present application provides a display panel. The display panel includes a pixel driving circuit and a light-emitting element. The pixel driving circuit includes an initialization signal terminal, a data signal terminal, a first initialization unit, a driving module and a first light-emitting control unit.

The first initialization unit is electrically connected between the initialization signal terminal and an anode of the light-emitting element. In a write frame, the first initialization unit is configured to, under the control of a first scan signal, provide the anode of the light-emitting element with a first initialization voltage signal Vref1. In a maintenance frame, the first initialization unit is configured to, under the control of the first scan signal, provide the anode of the light-emitting element with a second initialization voltage signal Vref2 which is different from the first initialization voltage signal Vref1.

The driving module and a first terminal of the first light-emitting control unit are electrically connected to a first node. A second terminal of the first light-emitting control unit is electrically connected to the anode of the light-emitting element. In the write frame and the maintenance frame, the first light-emitting control unit is configured to, under the control of a light-emitting control signal, control a driving current generated by the driving module to flow into the light-emitting element.

A time period corresponding to a valid pulse of the first scan signal is within a time period corresponding to an invalid pulse of the light-emitting control signal. In the write frame, the driving module is configured to receive a data voltage signal provided by the data signal terminal, and in the maintenance frame, the driving module is configured to do not receive the data voltage signal.

Through the above technical scheme, different initialization voltage signals are written into the anode of the light-emitting element in the write frame and the maintenance frame, such that the time required for the voltage of the anode of the light-emitting element to become a gray-level voltage (the magnitude of the gray-level voltage is related to the magnitude of the data voltage) is different at the initial light-emitting moment of the write frame and the initial light-emitting moment of the maintenance frame, so as to compensate for the difference of the time required for the voltage of the first node to become the gray-level voltage at the initial light-emitting moment of the write frame and the initial light-emitting moment of the maintenance frame. Therefore, finally, at the initial light-emitting moment of the write frame and the maintenance frame, the total time for the voltage of the first node to become the gray-level voltage and the total time for the voltage of the anode of the light-emitting element to become the gray-level voltage are approximate or even the same, thereby reducing the brightness difference between the write frame and the maintenance frame, ameliorating the issue of large brightness difference between the write frame and the maintenance frame, and achieving the effect of ameliorating the flicker and improving the display quality.

The technical schemes in the embodiments of the present application will be described clearly and completely hereinafter in conjunction with the drawings of the embodiments of the present application. Based on the embodiments of the present application, all other variations, modifications, additions or deletions obtained by those of ordinary skill are intended to fall within the scope of the present application.

Figure 2:
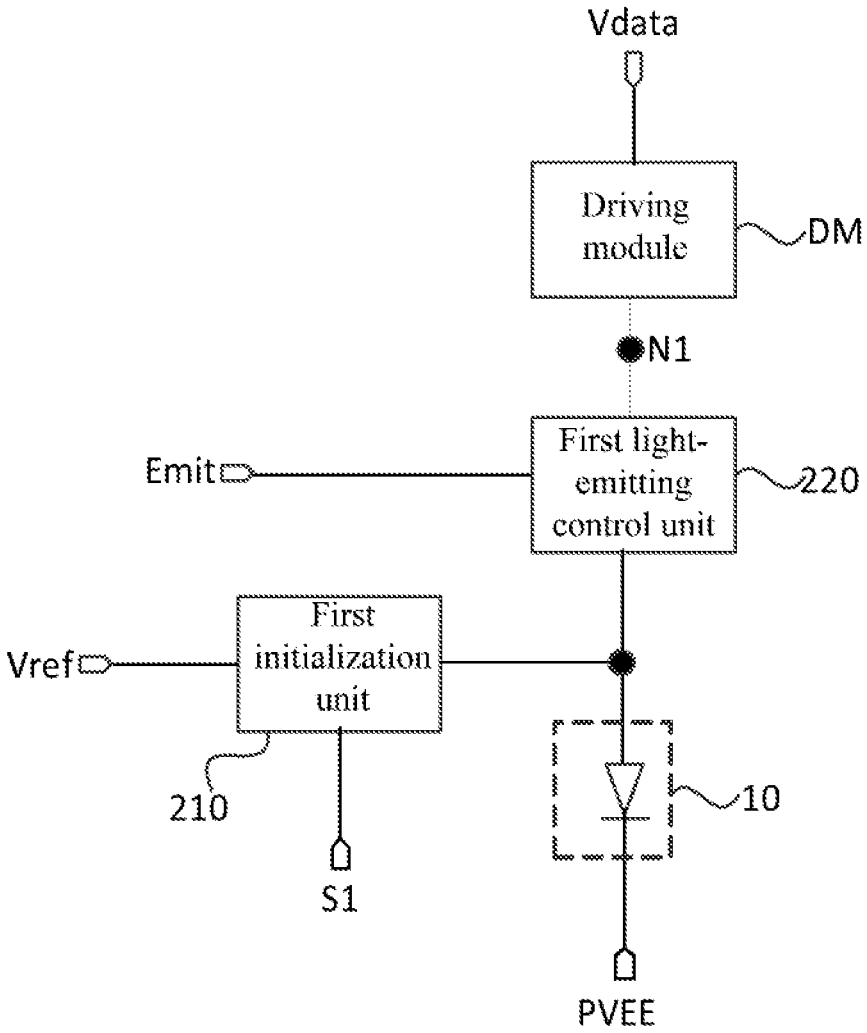
FIG. 2 is a schematic block diagram of a pixel driving circuit according to an embodiment of the present application.
Figure 3:
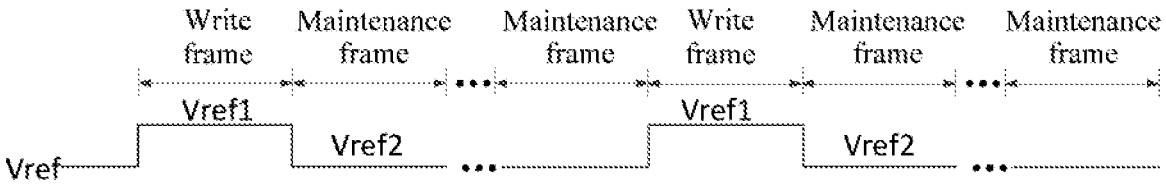
FIG. 3 is a timing diagram of signals of an initialization signal terminal according to an embodiment of the present application.

FIG. 1 is a schematic diagram of a display panel according to an embodiment of the present application. FIG. 2 is a schematic diagram of a pixel driving circuit according to an embodiment of the present application. FIG. 3 is a timing diagram of signals of an initialization signal terminal according to an embodiment of the present application. With concurrent references to FIGS. 1 to 3, the display device includes a pixel driving circuit 20 and a light-emitting element 10. The pixel driving circuit 20 includes an initialization signal terminal Vref, a data signal terminal Vdata, a first initialization unit 210, a driving module DM and a first light-emitting control unit 220. The first initialization unit 210 is electrically connected between the initialization signal terminal Vref and an anode of the light-emitting element 10. In a write frame, the first initialization unit 210 is configured to, under the control of a first scan signal, provide the anode of the light-emitting element 10 with a first initialization voltage signal Vref1. In a maintenance frame, the first initialization unit 210 is configured to, under the control of the first scan signal, provide the anode of the light-emitting element 10 with a second initialization voltage signal Vref2 which is different from the first initialization voltage signal Vref1. The driving module DM and a first terminal of the first light-emitting control unit 220 are electrically connected to a first node N1. A second terminal of the first light-emitting control unit 220 is electrically connected to the anode of the light-emitting element 10. A cathode of the light-emitting element 10 is electrically connected to a second power supply signal terminal PVEE. In the write frame and the maintenance frame, the first light-emitting control unit 220 is configured to, under the control of a light-emitting control signal, control a driving current generated by the driving module DM to flow into the light-emitting element.

A time period corresponding to a valid pulse of the first scan signal is within a time period corresponding to an invalid pulse of the light-emitting control signal. In the write frame, the driving module DM is configured to receive data represented by a voltage signal (alternatively referred to hereon as data voltage) provided by the data signal terminal Vdata, and in the maintenance frame, the driving module DM is configured not to receive the data voltage signal. It is to understood that the valid pulse described here and hereinafter refers to a pulse in a control signal (e.g., the first scan signal) that enables a unit (e.g., the first initialization unit 210) controlled by the control signal to be turned on. The invalid pulse refers to a pulse in a control signal (e.g., the light-emitting control signal) that enables a unit (e.g., the first light-emitting control unit 220) controlled by the control signal to be turned off.

In an embodiment, the display panel includes a display area AA and a non-display area DA surrounding the display area AA. The display area AA is provided with multiple sub-pixels. Each sub-pixel includes the pixel driving circuit 20 and the light emitting element 10. The pixel driving circuit 20 is configured to drive the light-emitting element 10 to emit light to display image information. The non-display area DA is used for being provided with peripheral circuits such as a gate driving circuit and a driving chip. It is understood that FIG. 1 is exemplary and only illustrates that multiple sub-pixels in the display panel are arranged in a matrix, but the present application is not limited thereto. Those skilled in the art may set the arrangement of the sub-pixels according in other suitable manners.

In an embodiment, the initialization signal terminal Vref of the pixel driving circuit 20 is configured to receive an initialization voltage signal (the first initialization voltage signal Vref1 or the second initialization voltage signal Vref2) in a time-division manner. The data signal terminal Vdata is configured to receive a data voltage signal. In the write frame, the driving module DM receives the data voltage signal provided by the data signal terminal Vdata, and the data voltage signal is written into the sub-pixel. In the maintenance frame, the driving module DM does not receive the data voltage signal and maintains a data voltage signal which is written into the write frame closest in time to the maintenance frame, and no new data voltage signal is written into the driving module DM.

In an embodiment, for each pixel driving circuit 20, the first initialization unit 210 is turned on during the time period corresponding to the valid pulse of the first scan signal, and an initialization voltage signal (the first initialization signal Vref1 or the second initialization signal Vref2) of the initialization signal terminal Vref is transmitted to the anode of the light-emitting element 10 through the first initialization unit 210 to reset the anode of the light-emitting element 10. The driving module DM is configured to generate a driving current according to the data voltage signal. In a time period corresponding to a valid level of the light-emitting control signal, the first light-emitting control unit 220 is turned on, and the driving current flows into the light-emitting element 10 through the first light-emitting control unit 220 to drive the light-emitting element 10 to emit light. It is understood that the valid level described here refers to a level in a control signal (e.g., the first scan signal) that enables a unit (e.g., the first initialization unit 210) controlled by the control signal to be turned on. In addition, the specific implementation form of the pixel driving circuit 20 can be set by those skilled in the art according to practical situations, which is not limited herein.

It is understood that FIG. 3 is exemplary and only illustrates that the initialization signal terminals Vref of the pixel driving circuits 20 in the same row are connected to the same initialization signal line VL, but the present application is not limited thereto. Those skilled in the art can set this according to other conditions. For example, in other implementations, the initialization signal terminal Vref of each pixel driving circuit 20 in the display panel may be set to be connected to the same initialization signal line VL; or, multiple pixel driving circuits 20 in the display panel are grouped into multiple pixel driving circuit groups, each pixel driving circuit group includes at least two pixel driving circuits 20, and the initialization signal terminals Vref of the pixel driving circuits 20 in the same pixel driving circuit group are connected to the same initialization signal line VL; or, the display panel includes multiple initialization signal lines VL, and the initialization signal terminals Vref of the pixel driving circuits are electrically connected to the initialization signal lines VL in a one-to-one correspondence. It is understood that the larger the number of the pixel driving circuits 20 electrically connected to each initialization signal line VL, the smaller the number of the initialization signal lines VL need to be set in the display panel, which is beneficial to reducing the space required for the initialization signal lines VL to be routed in the non-display area and beneficial to achieving the narrow frame and increasing the screen-to-body ratio. It is understood that, if the number of pixel driving circuits 20 electrically connected to each initialization signal line VL is small, when for some reason, one or some initialization signal lines VL continuously transmit an initialization voltage signal (called that the initialization signal lines VL fail), the pixel driving circuits which are not electrically connected to the one or some initialization signal lines VL can receive the first initialization voltage signal Vref1 and the second initialization voltage signal Vref2 in a time-division manner, that is, the effect of the failure of one initialization signal line VL on the display effect is relatively less. Compared with the related art, the issue of brightness difference between the write frame and the maintenance frame can also be ameliorated.

It is also understood that FIG. 3 is exemplary and only illustrates that the initialization voltage signal (the first initialization signal Vref1 or the second initialization signal Vref2) is input to one end (the left end shown in FIG. 1) of the initialization signal line VL, but the present application is not limited thereto. In other implementations, the initialization voltage signal may also be set to be input to both ends of the initialization signal line VL such that the voltage drop of the initialization voltage signal on the initialization signal line VL can be reduced, the difference of the initialization voltage signal received by pixel driving circuits 20 in the same row can be reduced, and the uniformity can be improved, thus the display effect is improved.

It is also understood that exemplary FIG. 3 only illustrates that the initialization signal terminal Vref of each pixel driving circuit receives the first initialization voltage signal Vref1 in the whole write frame and receives the second initialization voltage signal Vref2 in the whole maintenance frame, but the present application is not limited thereto. Those skilled in the art can set the timing of the initialization voltage signals of the initialization signal terminal Vref of each pixel driving circuit according to practical situations as long as the following conditions are satisfied: for each pixel driving circuit 20, the first initialization voltage signal Vref1 is output during the time period corresponding to the valid pulse of the first scan signal in the write frame, and the second initialization voltage signal Vref2 is output during the time period corresponding to a pulse of the second scan signal in the maintenance frame.

It is understood that for each pixel driving circuit 20, at the initial moment when the light-emitting control signal hops to an active level, the voltage of the first node N1 becomes the gray-level voltage (which matches the driving current), and the voltage of the anode of the light-emitting element 10 changes from the initialization voltage signal to the gray-level voltage. Different initialization voltage signals are written into the anode of the light-emitting element 10 in the write frame and the maintenance frame, so as to compensate for the difference of the time required for the voltage of the first node N1 to become the gray-level voltage in the write frame and the maintenance frame. Therefore, in the write frame and the maintenance frame, the total time for the voltage of the first node N1 to become the gray-level voltage and the total time for the voltage of the anode of the light-emitting element 10 to become the gray-level voltage are approximate or even the same, thereby reducing the brightness difference between the write frame and the maintenance frame, ameliorating the issue of large brightness difference between the write frame and the maintenance frame, and achieving the effect of ameliorating the flicker and improving the display quality.

In an embodiment, in the write frame, the voltage of the first node N1 at an initial light-emitting moment is V1, and in the maintenance frame, the voltage of the first node N1 at an initial light-emitting moment is V2, where $(V1-V2)*(Vref2-Vref1)>0$.

In an embodiment, the time required to change from V1 to the gray-level voltage is t1, the time required to change from V2 to the gray-level voltage is t2, the time required to change from Vref1 to the gray-level voltage is t3, and the time required to change from Vref2 to the gray-level voltage is t4. In the case where $V1>V2$, $t1<t2$, and $Vref1<Vref2$ are set, such that $t3>t4$ and finally $t1+t3$ and $t2+t4$ are the same or approximate, where $t1+t3$ and $t2+t4$ being approximate may refer to that $t1+t3$ and $t2+t4$ are substantially the same. In the case where $V1<V2$, $t1>t2$, and $Vref1>Vref2$ are set, such that $t3<t4$ and finally $t1+t3$ and $t2+t4$ are the same or approximate, where $t1+t3$ and $t2+t4$ being approximate may refer to that $t1+t3$ and $t2+t4$ are substantially the same.

It is understood that on the basis of $(V1-V2)*(Vref2-Vref1)>0$, those skilled in the art can set the specific values of the first initialization voltage signal Vref1 and the second initialization voltage signal Vref2 according to practical situations, which is not limited herein.

In an embodiment, there are various specific implementation forms of the pixel driving circuit 20, and the typical examples are described below, but the present application is not limited thereto.

Figure 4:
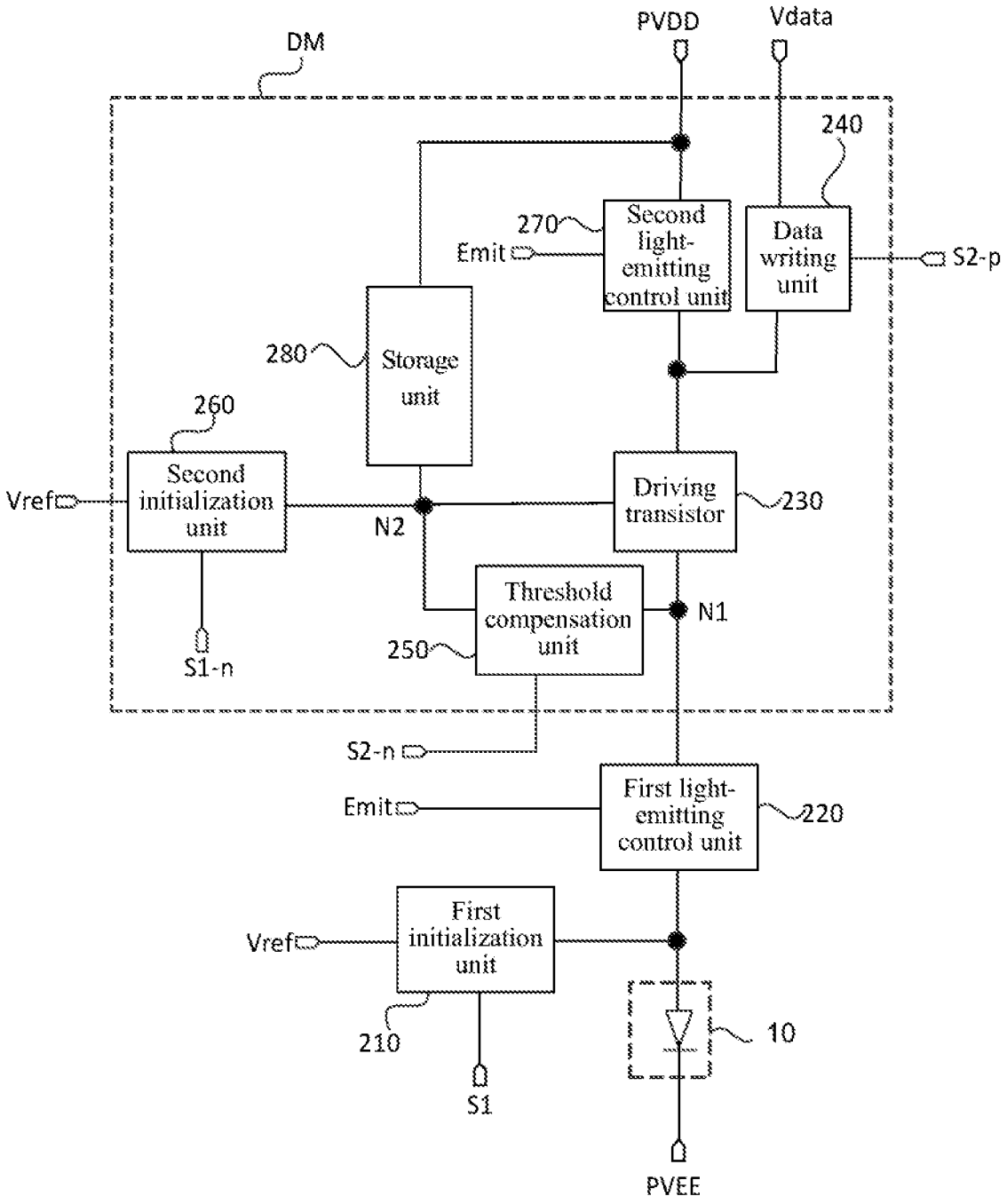
FIG. 4 is a schematic block diagram of a pixel driving circuit according to another embodiment of the present application.

FIG. 4 is a schematic block diagram of a pixel driving circuit according to another embodiment of the present application. With reference to FIG. 4, the pixel driving circuit 20 includes a first power supply signal terminal PVDD, a first scan signal terminal S1 for receiving a first scan signal, a second scan signal terminal S1-*n* for receiving a second scan signal, a third scan signal terminal S2-*p* for receiving a third scan signal, a fourth scan signal terminal S2-*n* for receiving a fourth scan signal, and a light-emitting control signal terminal Emit for receiving a light-emitting control signal. The driving module DM includes a storage unit 280, a driving transistor 230, a data writing unit 240, a threshold compensation unit 250, a second initialization unit 260, and a second light-emitting control unit 270.

In an embodiment, the second initialization unit 260 is electrically connected between the initialization signal terminal Vref and a second node N2. In a write frame, the second initialization unit 260 is configured to, under the control of a second scan signal, provide the second node N2 with the first initialization voltage signal Vref1.

In an embodiment, a control terminal of the driving transistor 230 and a first terminal of the storage unit 280 are electrically connected to the second node N2. A second terminal of the storage unit 280 is electrically connected to the first power supply signal terminal PVDD. The data writing unit 240 is electrically connected between the data signal terminal Vdata and a first electrode of the driving transistor 230. The threshold compensation unit 250 is electrically connected between a second electrode of the driving transistor 230 and the second node N2. In the write frame, the data writing unit 240 is configured to, under the control of the third scan signal, provide the second node N2 with the data voltage signal, and the threshold compensation unit 250 is configured to, under the control of the fourth scan signal, compensate a threshold voltage of the driving transistor 230 to the second node N2.

In an embodiment, the second light-emitting control unit 270 is electrically connected between the first power supply signal terminal PVDD and the first electrode of the driving transistor 230. In the write frame and the maintenance frame, the second light-emitting control unit 270 is configured to, under the control of the light-emitting control signal, write a first power supply voltage signal into the first electrode of the driving transistor 230, the driving transistor 230 is configured to generate a driving current according to the data voltage signal, and the first light-emitting control unit 220 is configured to, under the control of the light-emitting control signal, flow the driving current into the light-emitting element 10.

Figure 5:
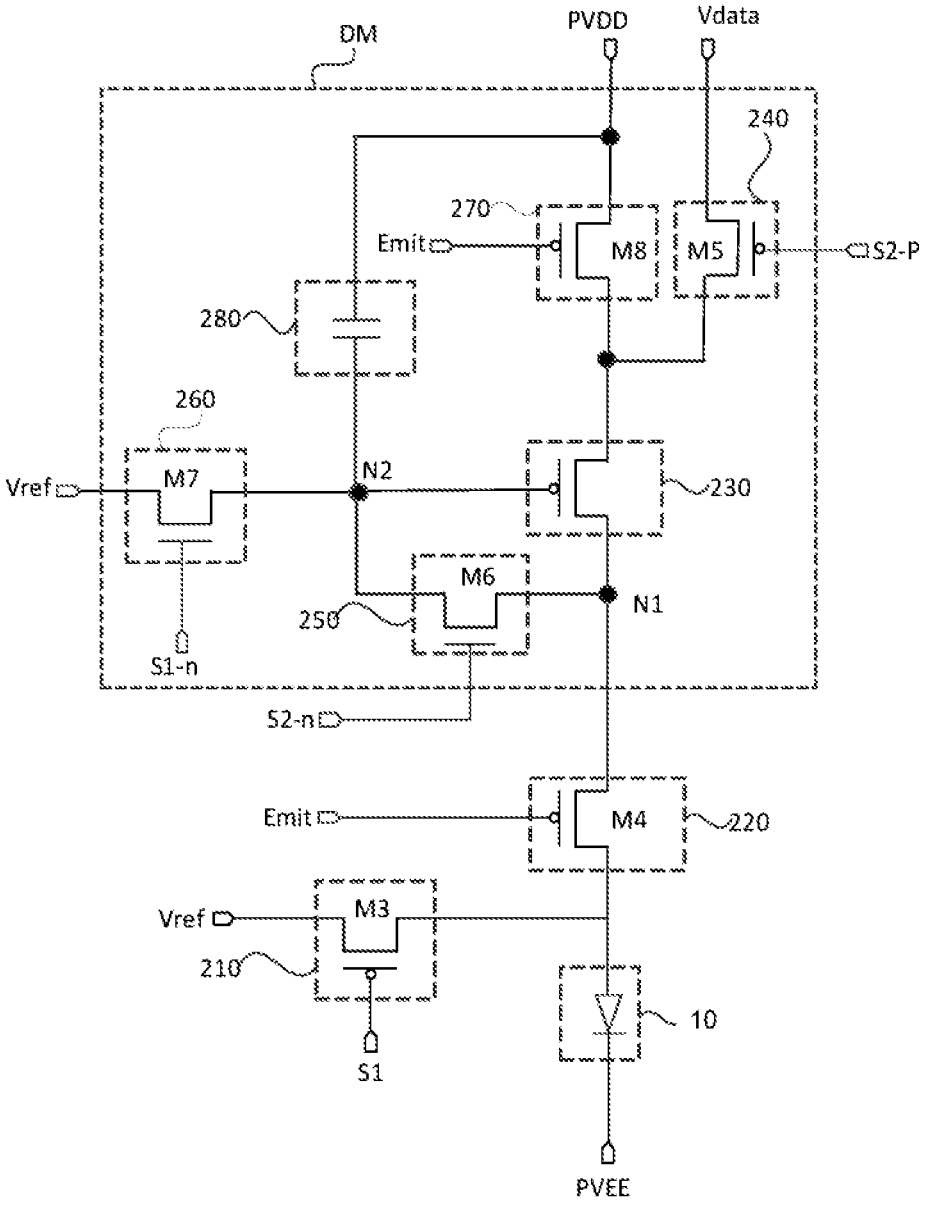
FIG. 5 is a schematic diagram of circuit elements of a pixel driving circuit according to an embodiment of the present application.

Exemplarily, FIG. 5 is a schematic diagram of circuit elements of a pixel driving circuit according to an embodiment of the present application. With reference to FIG. 5, the first initialization unit 210 includes a third transistor M3. A first electrode of the third transistor M3 is electrically connected to the initialization signal terminal Vref, a second electrode of the third transistor M3 is electrically connected to the anode of the light-emitting element 10, and a control terminal of the third transistor M3 is electrically connected to the first scan signal terminal S1. The first light-emitting control unit 220 includes a fourth transistor M4. A first electrode of the fourth transistor M4 is electrically connected to the second electrode of the driving transistor 230, a second electrode of the fourth transistor M4 is electrically connected to the anode of the light-emitting element 10, and a control terminal of the fourth transistor M4 is electrically connected to the light-emitting control signal terminal Emit. The data writing unit 240 includes a fifth transistor M5. A first electrode of the fifth transistor M5 is electrically connected to the data signal terminal Vdata, a second electrode of the fifth transistor M5 is electrically connected to the first electrode of the driving transistor 230, and a control terminal of the fifth transistor M5 is electrically connected to the third scan signal terminal S2-*p*. The threshold compensation module includes a sixth transistor M6. A first electrode of the sixth transistor M6 is electrically connected to the control terminal of the driving transistor 230, a second electrode of the sixth transistor M6 is electrically connected to the second electrode of the driving transistor 230, and a control terminal of the sixth transistor M6 is electrically connected to the fourth scan signal terminal S2-*n*. The second initialization unit 260 includes a seventh transistor M7. A first electrode of the seventh transistor M7 is electrically connected to the initialization signal terminal Vref, a second electrode of the seventh transistor M7 is electrically connected to the control terminal of the driving transistor 230, and a control terminal of the seventh transistor M7 is electrically connected to the second scan signal terminal S1-*n*. The second light-emitting control unit 270 includes an eighth transistor M8. A first electrode of the eighth transistor M8 is electrically connected to the first power supply signal terminal PVDD, a second electrode of the eighth transistor M8 is electrically connected to the first electrode of the driving transistor 230, and a control terminal of the eighth transistor M8 is electrically connected to the light-emitting control signal terminal Emit. The storage unit 280 includes a capacitor. A first terminal of the capacitor is electrically connected to the first power supply signal terminal PVDD, and a second terminal of the capacitor is electrically connected to the control terminal of the driving transistor 230.

In an embodiment, the transistor in the threshold compensation unit 250 and the transistor in the second initialization unit 260 are semiconductor oxide transistors. In this example, the transistor in the threshold compensation unit 250 and the transistor in the second initialization unit 260 are indium-gallium-zinc-oxide transistors. With reference to FIG. 5, the sixth transistor M6 and the seventh transistor M7 are indium-gallium-zinc-oxide transistors.

It is understood that the leakage current of the semiconductor oxide transistor is relatively small, which is beneficial to stabilizing the voltage of the second node N2, thereby stabilizing the driving current generated by the driving transistor 230 and improving the uniformity of the luminance of the light-emitting element 10.

Figure 6:
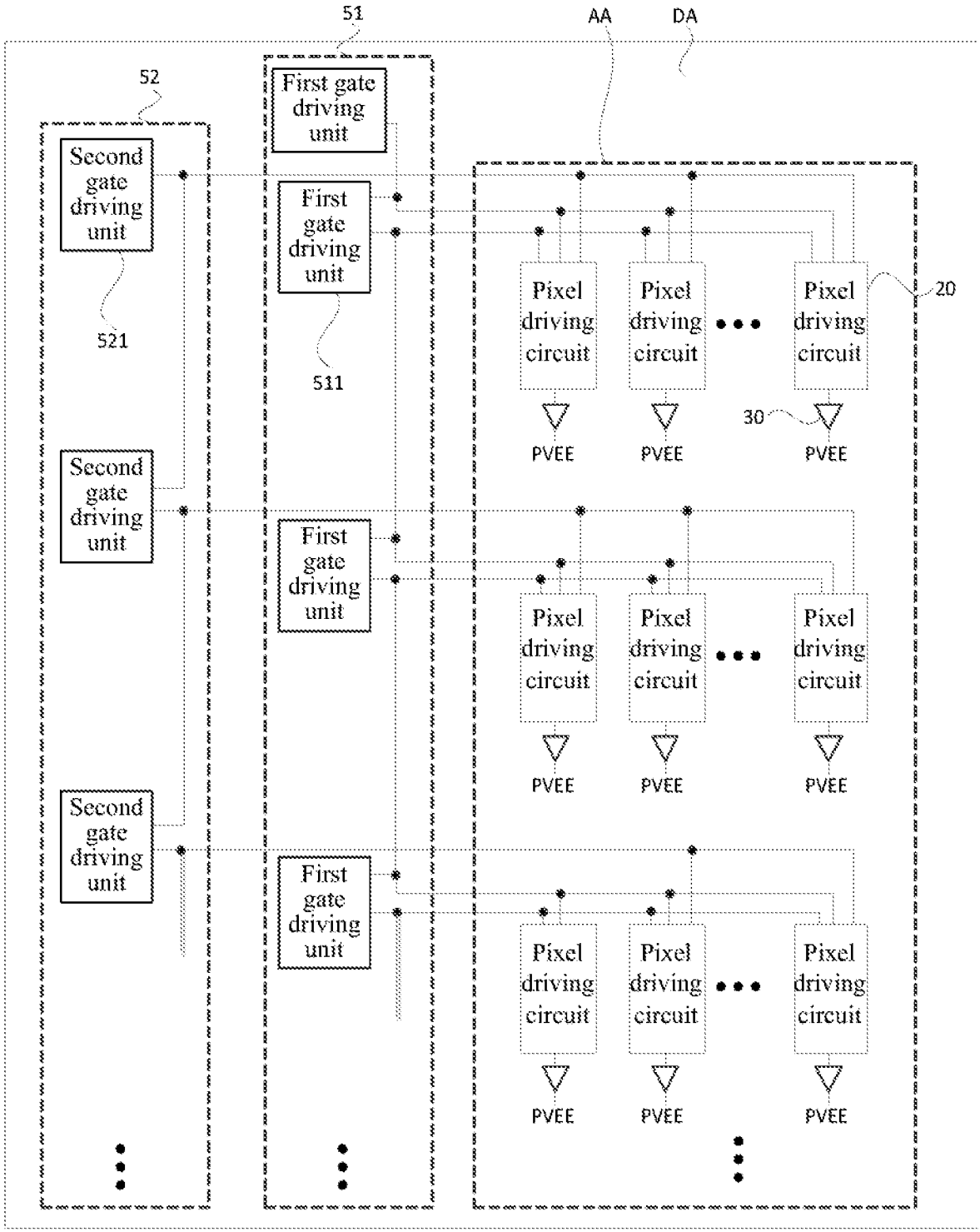
FIG. 6 is a schematic diagram of a display panel according to another embodiment of the present application.

FIG. 6 is a schematic diagram of a display panel according to another embodiment of the present application. With reference to FIG. 6, the display panel includes N rows of pixel driving circuits 20, a first gate driving circuit 51, a second gate driving circuit 52 and a light-emitting control circuit (not shown in FIG. 6). The first gate driving circuit 51 includes (N+1)-stage (from 0th stage to Nth stage) cascaded first gate driving units. An input terminal of the current-stage first gate driving unit is electrically connected to an output terminal of the previous-stage first gate driving unit. The second gate driving circuit includes N-stage (from 1st stage to Nth stage) cascaded second gate driving units. An input terminal of the current-stage second gate driving unit is electrically connected to an output terminal of the previous-stage second gate driving unit. The light-emitting control circuit includes N-stage (from 1st stage to Nth stage) cascaded light-emitting control units. An input terminal of the current-stage light-emitting control unit is electrically connected to an output terminal of the previous-stage light-emitting control unit. In the above, N is an integer greater than or equal to 2.

With concurrent references to FIGS. 4 to 6, in an embodiment, which circuit in the display panel is connected to the first scan signal terminal S1 in the pixel driving circuit 20 is described below. The second scan signal terminals S1-*n* of the pixel driving circuits 20 in the i-th row are connected to an output terminal of the first gate driving unit at the (i−1)-th stage; the third scan signal terminals S2-*p* of the pixel driving circuits 20 in the i-th row are connected to an output terminal of the second gate driving unit at the i-th stage; the fourth scan signal terminals S2-*n* of the pixel driving circuits 20 in the i-th row are connected to an output terminal of the first gate driving unit at the i-th stage; and the light-emitting control signal terminal Emit of the pixel driving circuits 20 in the i-th row are connected to an output terminal of the light-emitting control unit at the i-th stage; where i is an integer and $1 \leq i \leq N$.

It is understood that through the above arrangement, one first gate driving circuit can output the second scan signal and the fourth scan signal. Compared with the case that the second scan signal and the fourth scan signal are generated by two different gate driving circuits respectively, through the above arrangement, the number of gate driving circuits can be reduced, which is beneficial to reducing costs and increasing the screen-to-body ratio.

In an embodiment, there are various specific implementation forms of the first scan signal. For example, the first scan signal may be provided directly by the driving chip, provided by a first scan signal generation circuit (disposed in the non-display area DA of the display panel), or multiplexed with other control signals in the pixel driving circuit 20. It is understood that when the first scan signal is multiplexed with other control signals, the use of pin resources of the driving chip can be reduced and circuits for generating some control signals may not be required, thereby reducing the design difficulty of the display panel.

As to what kind of signals in the pixel driving circuit 20 the first scan signal may be multiplexed with, typical examples are described below, but the present application is not limited thereto.

Figure 7:
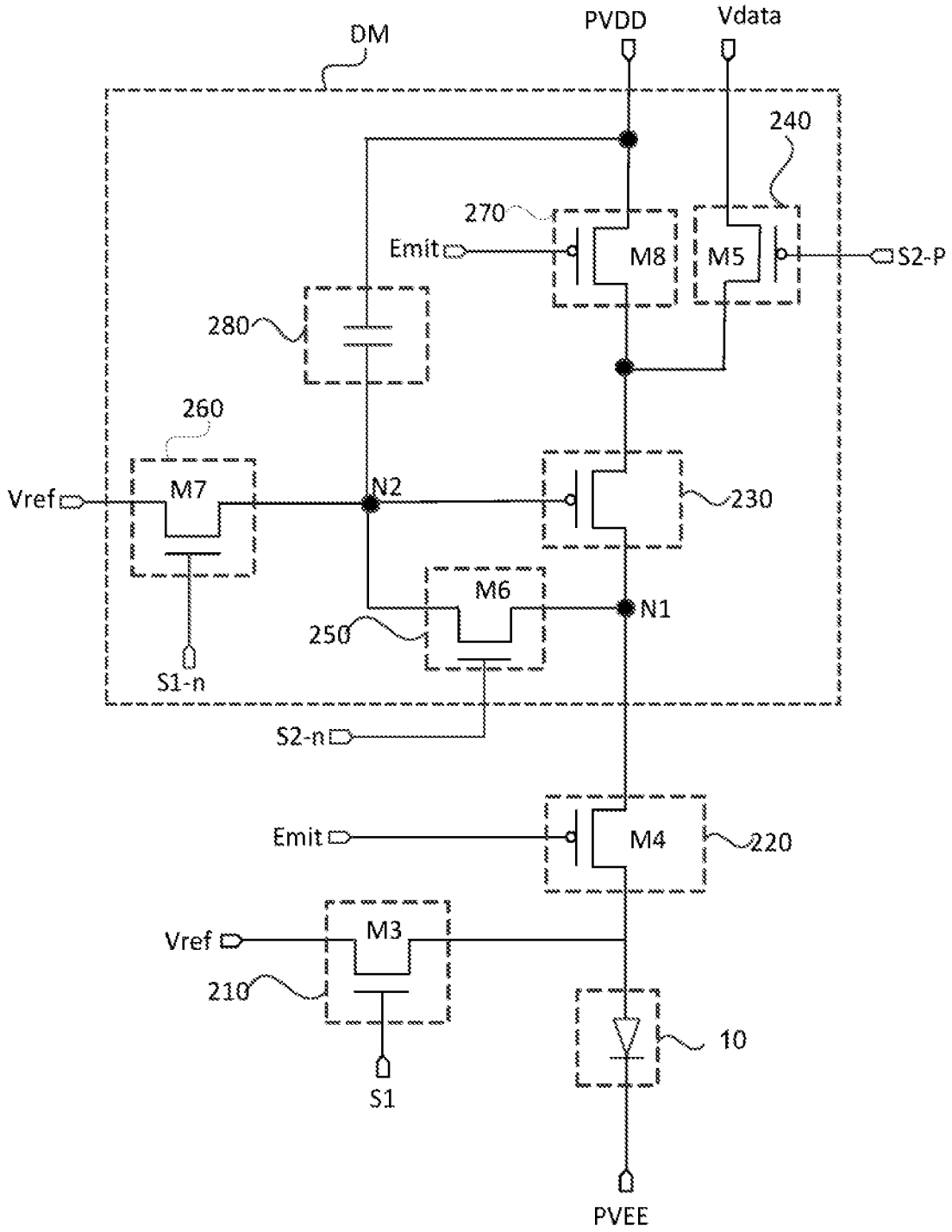
FIG. 7 is a schematic diagram of circuit elements of a pixel driving circuit according to another embodiment of the present application.
Figure 8:
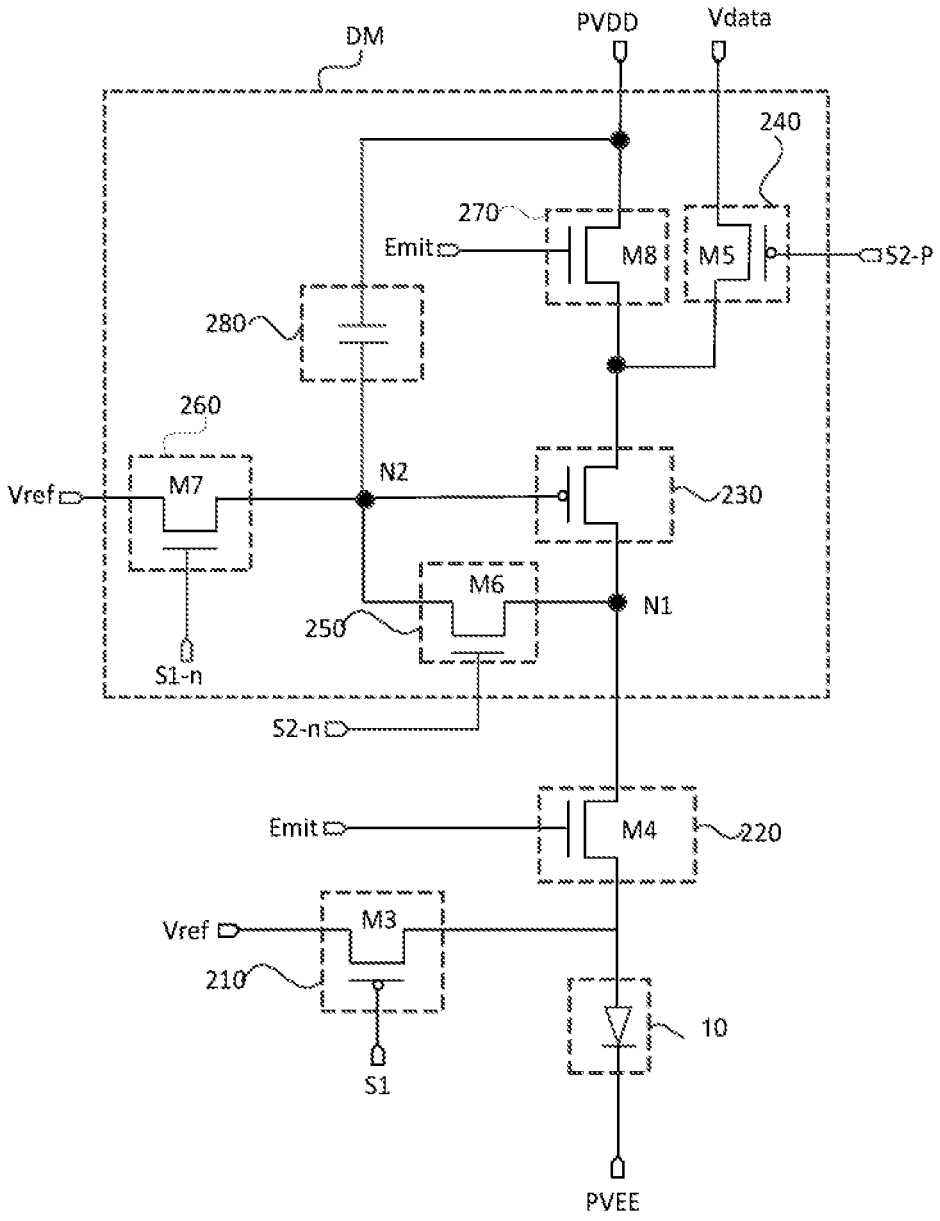
FIG. 8 is a schematic diagram of circuit elements of a pixel driving circuit according to another embodiment of the present application.

FIG. 7 is a schematic diagram of circuit elements of a pixel driving circuit according to another embodiment of the present application. FIG. 8 is a schematic diagram of circuit elements of a pixel driving circuit according to another embodiment of the present application. With reference to FIGS. 7 and 8, in an embodiment, a transistor in the first initialization unit 210 is an N-type transistor, and a transistor in the first light-emitting control unit 220 is a P-type transistor (as shown in FIG. 7); or the transistor in the first initialization unit 210 is a P-type transistor, and the transistor in the first light-emitting control unit 220 is an N-type transistor (as shown in FIG. 8); and the light-emitting control signal is multiplexed as the first scan signal.

With reference to FIG. 7, the third transistor M3 is an N-type transistor, the fourth transistor M4 is a P-type transistor, and the eighth transistor M8 is also a P-type transistor; or with reference to FIG. 8, the third transistor M3 is a P-type transistor, the fourth transistor M4 is an N-type transistor, and the eighth transistor M8 is also an N-type transistor.

Figure 9:
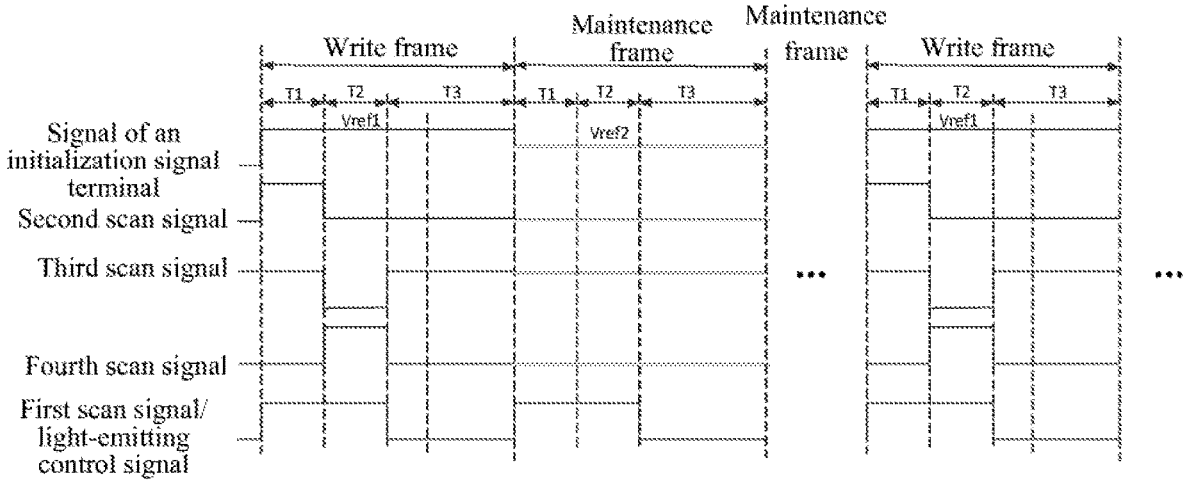
FIG. 9 is a driving timing diagram of a display panel according to an embodiment of the present application.
Figure 10:
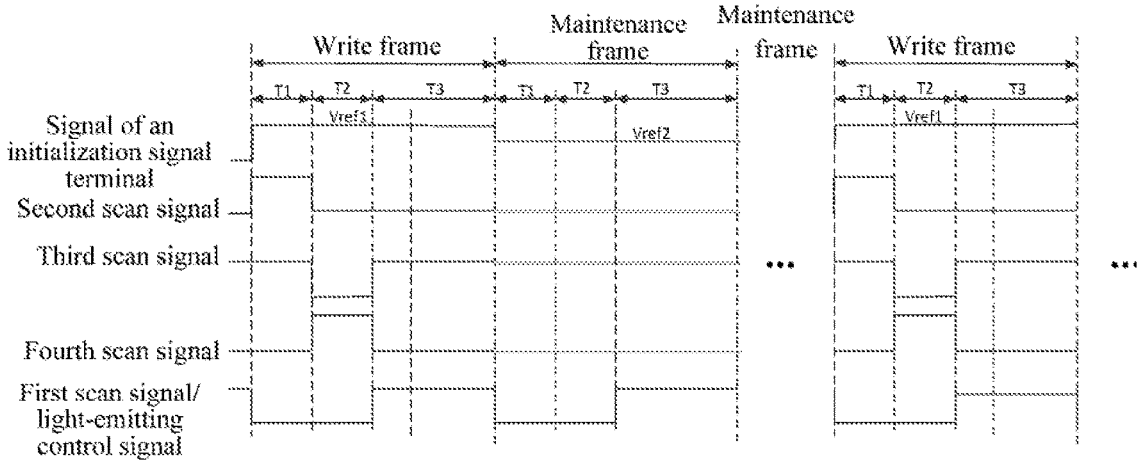
FIG. 10 is a driving timing diagram of a display panel according to another embodiment of the present application.

FIG. 9 is a driving timing diagram of a display panel according to an embodiment of the present application. FIG. 10 is a driving timing diagram of a display panel according to another embodiment of the present application. The driving timing shown in FIG. 9 corresponds to a display panel including the pixel driving circuit 20 shown in FIG. 7, and the driving timing shown in FIG. 10 corresponds to a display panel including the pixel driving circuit 20 shown in FIG. 8. With reference to FIGS. 9 and 10, in the write frame, a time period in which the initialization signal terminal Vref continuously receives the first initialization voltage signal Vref1 at least overlaps the time period corresponding to the invalid pulse of the light-emitting control signal; and in the maintenance frame, a time period in which the initialization signal terminal Vref continuously receives the second initialization voltage signal Vref2 at least overlaps the time period corresponding to the invalid pulse of the light-emitting control signal.

In the driving timings shown in FIGS. 9 and 10, the operation process of the pixel driving circuit 20 is as follows. At an initialization stage T1 of the write frame, the first initialization unit 210 and the second initialization unit 260 are turned on, the first initialization unit 210 provides the anode of the light-emitting element 10 with the first initialization voltage signal Vref1, and the second initialization unit 260 provides the second node N2 with the first initialization voltage signal Vref1. At a data writing stage T2 of the write frame, the first initialization unit 210 is turned on, the first initialization unit 210 provides the anode of the light-emitting element 10 with the first initialization voltage signal Vref1, and at the same time, the data writing unit 240 and the threshold compensation unit 250 are turned on, and the data voltage signal of the data signal terminal Vdata is written into the second node N2 through the data writing unit 240, the driving transistor 230 and the threshold compensation unit 250 sequentially, such that the voltage of the gate (that is, the control terminal of the driving transistor 230) of the driving transistor 230 gradually rises until the difference between the voltage of the gate of the driving transistor 230 and the voltage of the first electrode of the driving transistor 230 is equal to the threshold voltage of the driving transistor 230, and the drive transistor 230 is turned off. At a light-emitting stage T3 of the write frame, the first light-emitting control unit 220 and the second light-emitting control unit 270 are turned on, the driving current generated by the driving transistor 230 flows into the light-emitting element 10, and the light-emitting element 10 emits light in response to the driving current. At an initialization stage T1 and a data writing stage T2 of the maintenance frame, the first initialization unit 210 is turned on, and the first initialization unit 210 provides the anode of the light-emitting element 10 with the second initialization voltage signal Vref2. At a light-emitting stage T3 of the maintenance frame, the first light-emitting control unit 220 and the second light-emitting control unit 270 are turned on, the driving current generated by the driving transistor 230 flows into the light-emitting element 10, and the light-emitting element 10 emits light in response to the driving current.

It is to understood that the exemplary timings illustrated in FIGS. 9 and 10 correspond to the case in which the fifth transistor M5 and the driving transistor 230 are P-type transistors, and the sixth transistor M6 and the seventh transistor M7 are N-type transistors, however, the present application is not limited thereto. The type of each of the fifth transistor M5, the driving transistor 230, the sixth transistor M6 and the seventh transistor M7 in the pixel driving circuit 20 are not limited to the embodiments shown and describe herein.

With reference to FIG. 5, in an embodiment, the transistor in the data writing unit 240 and the transistor in the first initialization unit 210 are of the same type; and the first scan signal is multiplexed as the third scan signal.

Figure 12:
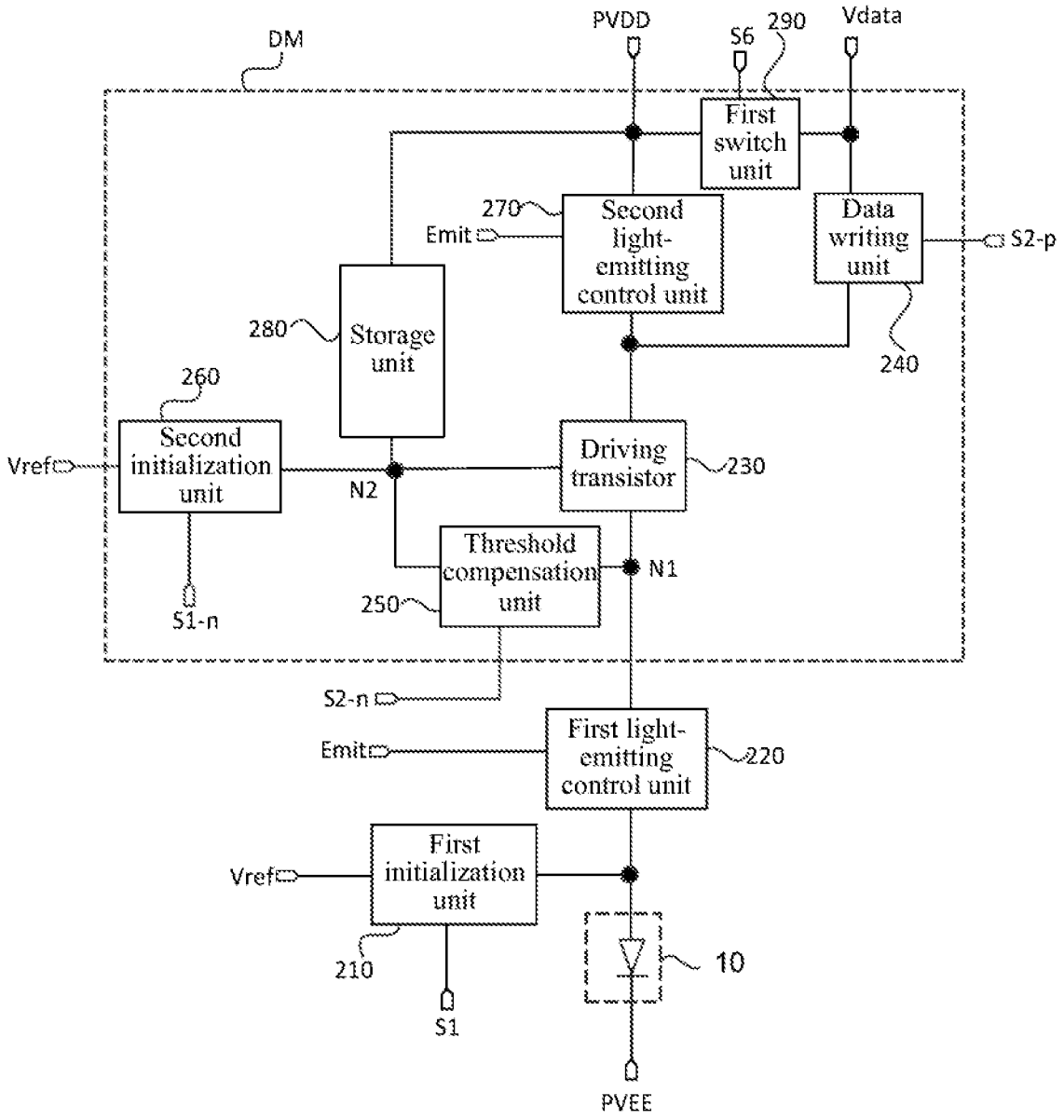
FIG. 12 is a schematic block diagram of a pixel driving circuit according to another embodiment of the present application.

In an embodiment, the fifth transistor M5 and the third transistor M3 are of the same type, and the both may be P-type transistors (as shown in FIG. 12), or may be N-type transistors, which is not limited herein.

Figure 11:
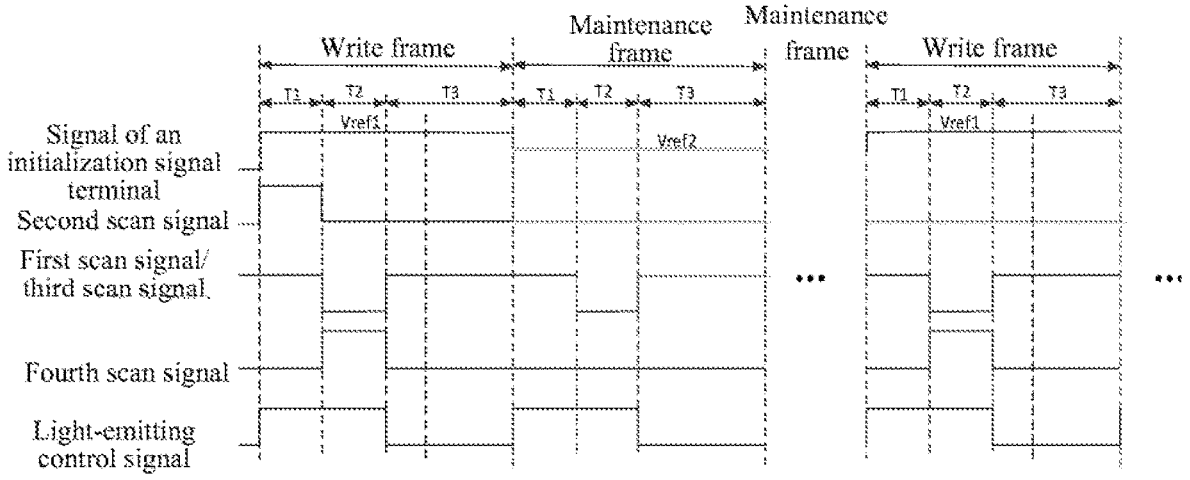
FIG. 11 is a driving timing diagram of a display panel according to another embodiment of the present application.

FIG. 11 is a driving timing diagram of a display panel according to another embodiment of the present application. With reference to FIG. 11, in the write frame, the time period in which the initialization signal terminal Vref continuously receives the first initialization voltage signal Vref1 at least overlaps a time period corresponding to a valid pulse of the third scan signal; and in the maintenance frame, the time period in which the initialization signal terminal Vref continuously receives the second initialization voltage signal Vref2 at least overlaps the time period corresponding to the valid pulse of the third scan signal.

In the driving timing shown in FIG. 11, the operation process of the pixel driving circuit 20 is as follows. At the initialization stage T1 of the write frame, the second initialization unit 260 is turned on, and the second initialization unit 260 provides the second node N2 with the first initialization voltage signal Vref1. At the data writing stage T2 of the write frame, the first initialization unit 210 is turned on, the first initialization unit 210 provides the anode of the light-emitting element 10 with the first initialization voltage signal Vref1, and at the same time, the data writing unit 240 and the threshold compensation unit 250 are turned on, and the data voltage signal of the data signal terminal Vdata is written into the second node N2 through the data writing unit 240, the driving transistor 230 and the threshold compensation unit 250 sequentially. At the light-emitting stage T3 of the write frame, the first light-emitting control unit 220 and the second light-emitting control unit 270 are turned on, the driving current generated by the driving transistor 230 flows into the light-emitting element 10, and the light-emitting element 10 emits light in response to the driving current. At the initialization stage T1 of the maintenance frame, there is no operation. At the data writing stage T2 of the maintenance frame, the first initialization unit 210 and the data writing unit 240 are turned on, the first initialization unit 210 provides the anode of the light-emitting element 10 with the second initialization voltage signal Vref2, and the data writing unit 240 is connected between the data voltage signal terminal and the first electrode of the driving transistor 230 in floating. At the light-emitting stage T3 of the maintenance frame, the first light-emitting control unit 220 and the second light-emitting control unit 270 are turned on, the driving current generated by the driving transistor 230 flows into the light-emitting element 10, and the light-emitting element 10 emits light in response to the driving current.

In an embodiment, in the maintenance frame, the data writing unit 240, under the control of the third scan signal, transmits a fixed voltage signal provided by the data signal terminal Vdata to the first electrode of the driving transistor 230, where a voltage value of the fixed voltage signal is equal to a voltage value of the first power supply voltage signal.

It is understood that at an end moment of the data writing stage T2 of the write frame, the voltage of the first electrode of the driving transistor 230 is the voltage value corresponding to the data voltage signal, which is called vdata, and then at an initial moment of the light-emitting stage T3, the voltage of the first electrode of the driving transistor 230 changes from the determined voltage value vdata to the voltage value of the first power supply signal terminal PVDD, which is called pvdd. When the first scan signal is multiplexed as the third scan signal, at the data writing stage T2 of the maintenance frame, the data writing unit 240 is also turned on, and the data signal terminal Vdata provides the fixed voltage signal, such that the voltage value of the first electrode of the driving transistor 230 at the end moment of the data writing stage T2 is a determined value, such as pvdd, or is a voltage value corresponding to a data voltage signal written into the write frame closest in time to this maintenance frame. In this way, no matter in the write frame or the maintenance frame, at the initial moment of the light-emitting stage T3, the voltage value of the driving transistor 230 changes from a fixed potential to pvdd, thereby avoiding that floating occurs at the first electrode of the driving transistor 230, avoiding the instability of the potential of the first electrode of the driving transistor 230 at the light-emitting stage T3 and making the first electrode of the driving transistor 230 relatively controllable, and reducing the risk of display instability.

Figure 13:
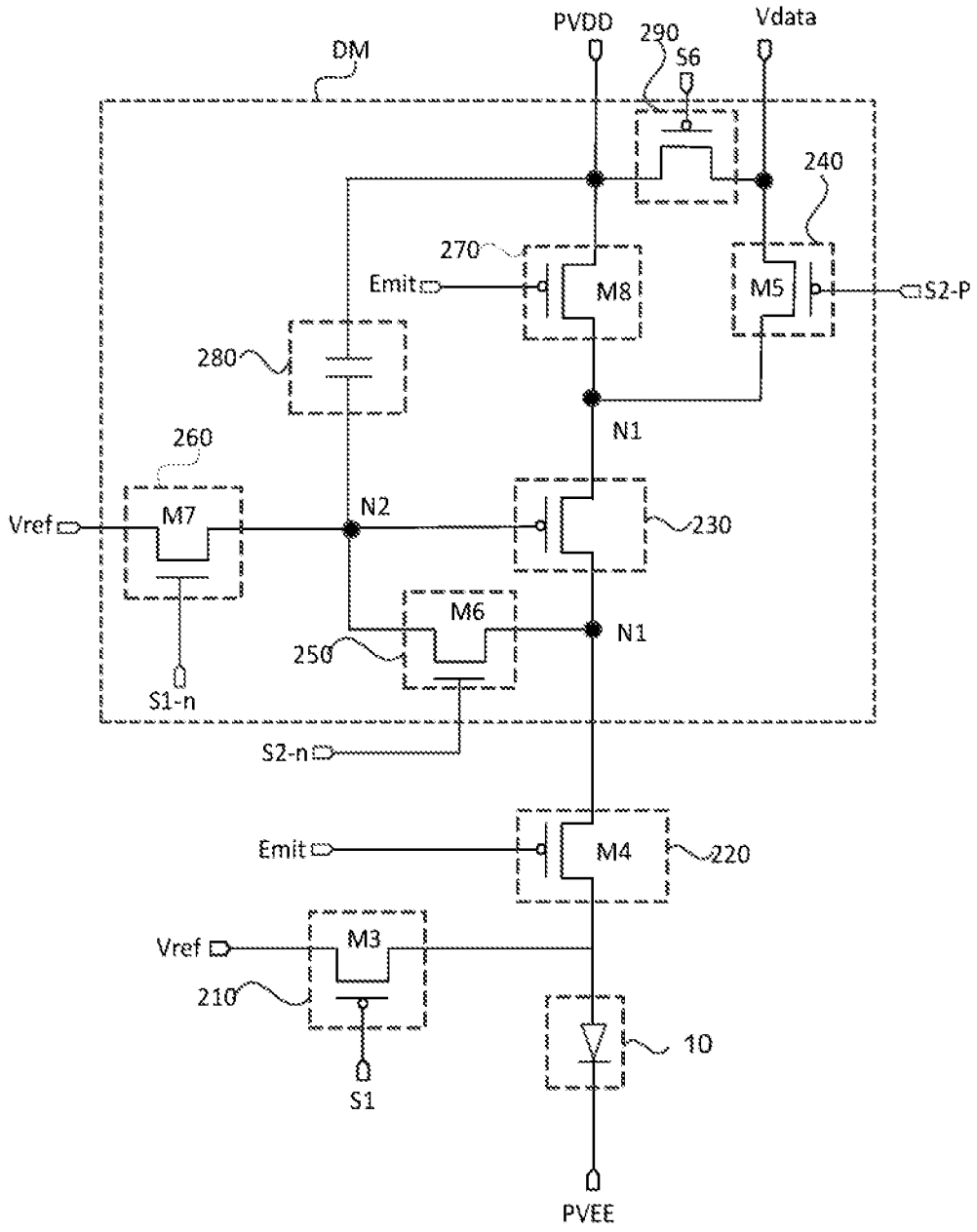
FIG. 13 is a schematic diagram of circuit elements of a pixel driving circuit according to another embodiment of the present application.

FIG. 12 is a schematic block diagram of a pixel driving circuit according to another embodiment of the present application. FIG. 13 is a schematic diagram of circuit elements of another pixel driving circuit according to an embodiment of the present application. With reference to FIGS. 12 and 13, in an embodiment, the pixel driving circuit 20 further includes a first switch unit 290 electrically connected between the data writing unit 240 and the first power supply signal terminal PVDD. In the maintenance frame, the first switch unit 290 is configured to transmit the first power supply voltage signal to the data writing unit 240 such that the data writing unit 240, under the control of the third scan signal, provides the first electrode of the driving transistor 230 with the first power supply voltage signal.

In an embodiment, the pixel driving circuit 20 further includes a sixth scan signal terminal S6 for receiving a sixth scan signal. A control terminal of the first switch unit 290 is connected to the sixth scan signal terminal S6. In the write frame, the first switch unit 290 is configured to be turned off under the control of the sixth scan signal, and in the maintenance frame, the first switch unit 290 is configured to be turned on at least at the data writing stage T2 under the control of the sixth scan signal, such that the first power supply voltage signal is written into the first electrode of the driving transistor 230 through the first switch unit 290 and the data writing unit 240 sequentially. In an embodiment, the first switch unit 290 includes a ninth transistor M9. A first electrode of the ninth transistor M9 is electrically connected to the data signal terminal Vdata, a second electrode of the ninth transistor M9 is electrically connected to the first power supply signal terminal PVDD, and a control terminal of the ninth transistor M9 is electrically connected to the sixth scan signal terminal S6.

Figure 14:
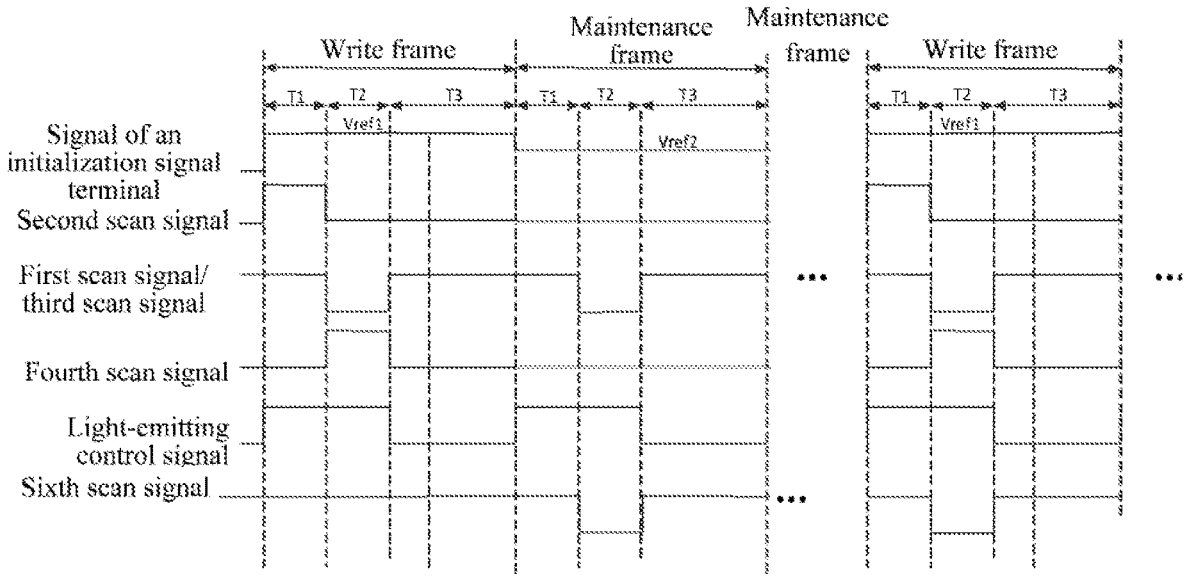
FIG. 14 is a driving timing diagram of a display panel according to another embodiment of the present application.

FIG. 14 is a driving timing diagram of a display panel according to another embodiment of the present application. In the driving timing shown in FIG. 14, the operation process of the pixel driving circuit 20 is as follows. At the initialization stage T1 of the write frame, the second initialization unit 260 is turned on, and the second initialization unit 260 provides the second node N2 with the first initialization voltage signal Vref1. At the data writing stage T2 of the write frame, the first initialization unit 210 is turned on, the first initialization unit 210 provides the anode of the light-emitting element 10 with the first initialization voltage signal Vref1, and at the same time, the data writing unit 240 and the threshold compensation unit 250 are turned on, and the data voltage signal of the data signal terminal Vdata is written into the second node N2 through the data writing unit 240, the driving transistor 230 and the threshold compensation unit 250 sequentially. At the light-emitting stage T3 of the write frame, the first light-emitting control unit 220 and the second light-emitting control unit 270 are turned on, the driving current generated by the driving transistor 230 flows into the light-emitting element 10, and the light-emitting element 10 emits light in response to the driving current. At the initialization stage T1 of the maintenance frame, there is no operation. At the data writing stage T2 of the maintenance frame, the first initialization unit 210 is turned on, the first initialization unit 210 provides the anode of the light-emitting element 10 with the second initialization voltage signal Vref2, and at the same time, the data writing unit 240 and the first switch unit 290 are turned on, and the first power supply voltage signal is written into the first electrode of the driving transistor 230 through the data writing unit 240 and the first switch unit 290 sequentially. At the light-emitting stage T3 of the maintenance frame, the first light-emitting control unit 220 and the second light-emitting control unit 270 are turned on, the driving current generated by the driving transistor 230 flows into the light-emitting element 10, and the light-emitting element 10 emits light in response to the driving current.

It is understood that the timings examples illustrated in FIGS. 10, 11 and 14 correspond to the case in which the third transistor M3, the fourth transistor M4, the fifth transistor M5, the eighth transistor M8, the ninth transistor M9 and the driving transistor 230 are P-type transistors, and the sixth transistor M6 and the seventh transistor M7 are N-type transistors, however, the present application is not limited thereto. The type of each transistor in the pixel driving circuit 20 is not limited in the embodiments of the present application.

Figure 15:
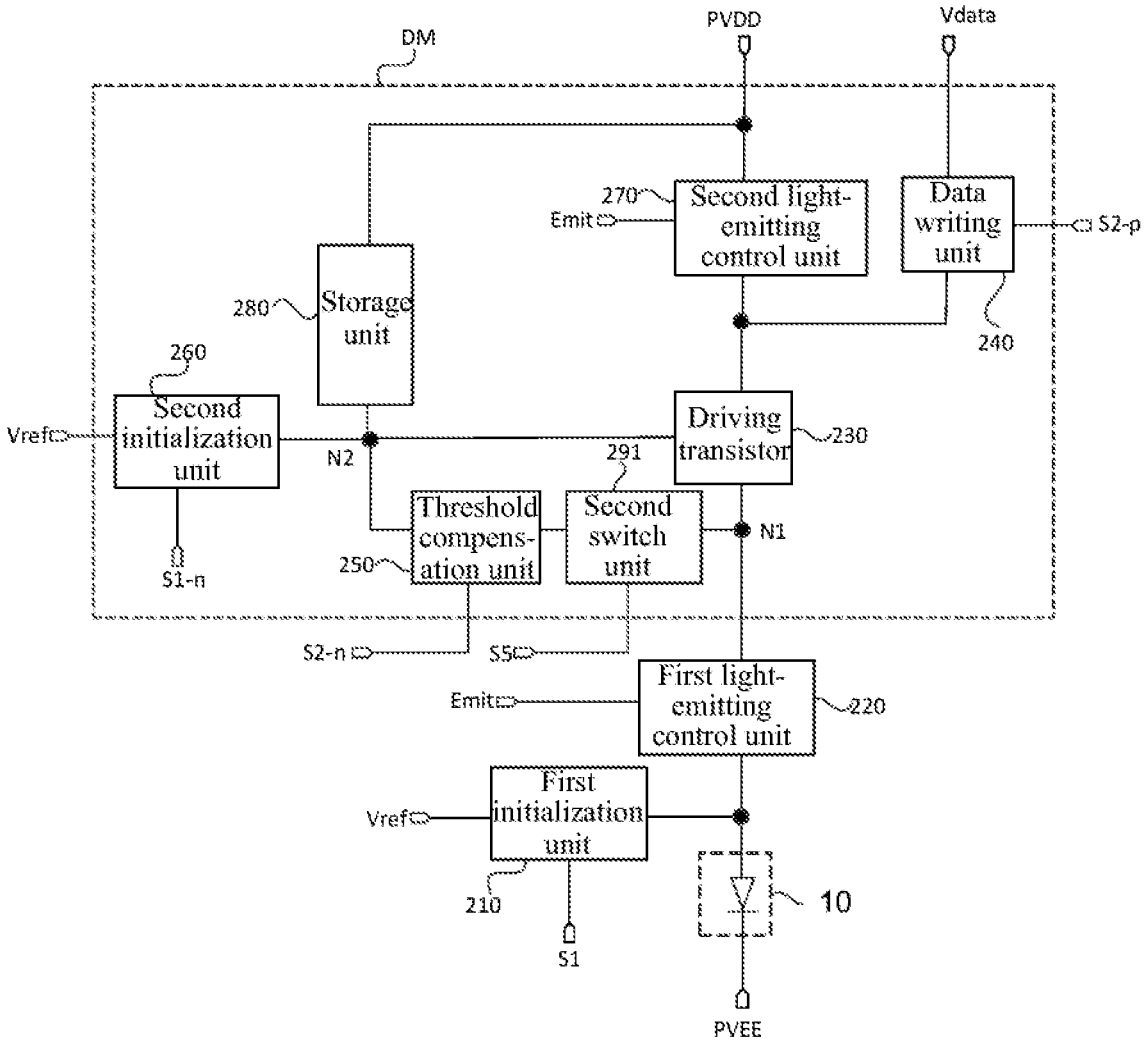
FIG. 15 is a schematic block diagram of a pixel driving circuit according to another embodiment of the present application.
Figure 16:
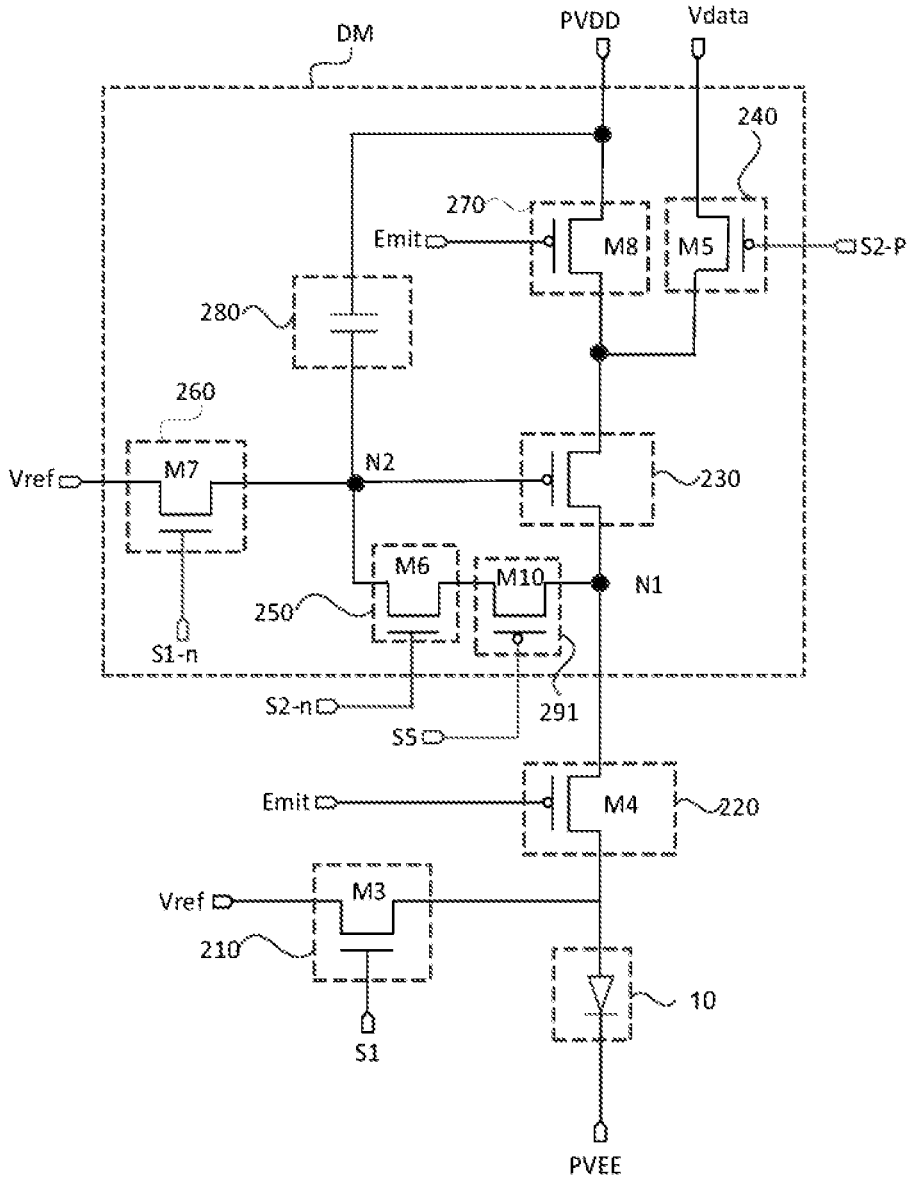
FIG. 16 is a schematic diagram of circuit elements of a pixel driving circuit according to an embodiment of the present application.
Figure 17:
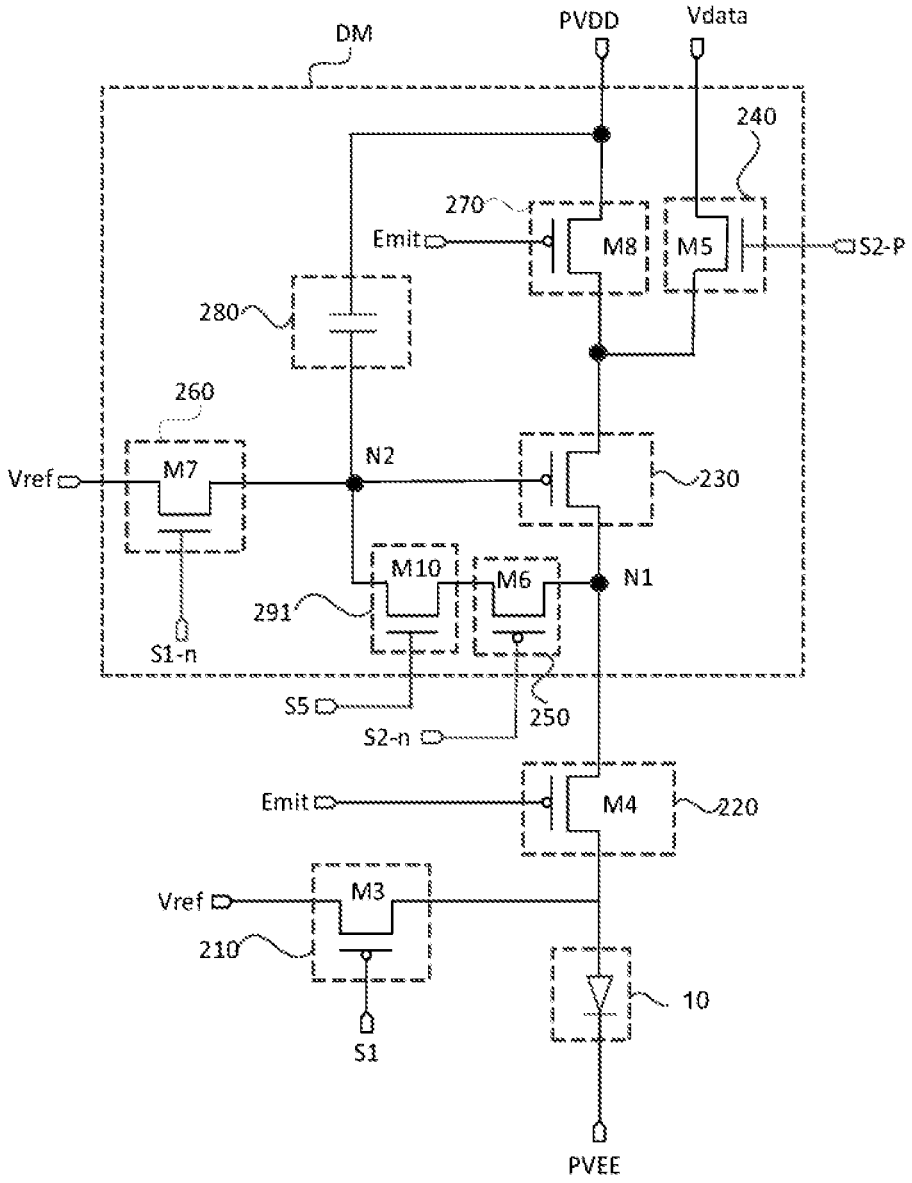
FIG. 17 is a schematic diagram of circuit elements of a pixel driving circuit according to another embodiment of the present application.
Figure 18:
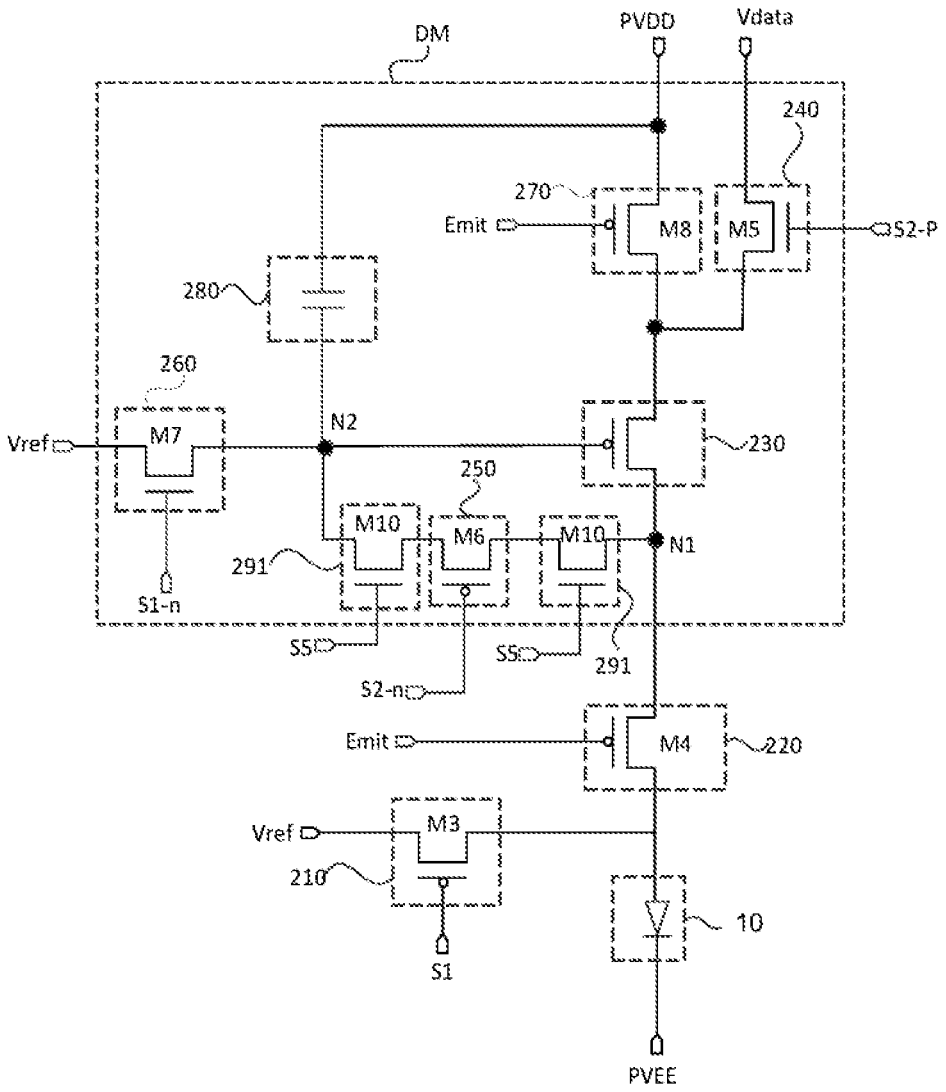
FIG. 18 is a schematic diagram of circuit elements of a pixel driving circuit according to another embodiment of the present application.

FIG. 15 is a schematic block diagram of a pixel driving circuit according to another embodiment of the present application. FIG. 16 is a schematic diagram of circuit elements of a pixel driving circuit according to an embodiment of the present application. FIG. 17 is a schematic diagram of circuit elements of a pixel driving circuit according to another embodiment of the present application. FIG. 18 is a schematic diagram of circuit elements of a pixel driving circuit according to another embodiment of the present application. With reference to FIGS. 15 to 18, in an embodiment, the transistor in the threshold compensation unit 250 and the transistor in the first initialization unit 210 are of the same type, and the first scan signal is multiplexed as the fourth scan signal. The pixel driving circuit 20 further includes at least one second switch unit 291. The second switch unit 291 is electrically connected between a first terminal of the threshold compensation unit 250 and the second node N2, and/or the second switch unit 291 is electrically connected between a second terminal of the threshold compensation unit 250 and the second electrode of the driving transistor 230. In the maintenance frame, the second switch unit 291 is configured to, under the control of a fifth scan signal, prevent the second electrode of the driving transistor 230 from being conducted with the second node N2.

In an embodiment, the pixel driving circuit 20 further includes a fifth scan signal terminal S5 for receiving the fifth scan signal. A control terminal of the second switch unit 291 is connected to the fifth scan signal terminal S5. At the data writing stage T2 of the write frame, the second switch unit 291 is configured to be turned on under the control of the fifth scan signal, and in the maintenance frame, the second switch unit 291 is configured to be turned off at least at the data writing stage T2 under the control of the fifth scan signal. In an embodiment, the second switch unit 291 includes a tenth transistor M10. When the second switch unit 291 is electrically connected between the first terminal of the threshold compensation unit 250 and the second node N2, a first electrode of the tenth transistor M10 is electrically connected to the second node N2, a second electrode of the tenth transistor M10 is electrically connected to the first terminal of the threshold compensation unit 250, and a control terminal of the tenth transistor M10 is electrically connected to the fifth scan signal terminal S5, as shown in FIGS. 17 and 18. When the second switch unit 291 is electrically connected between the second terminal of the threshold compensation unit 250 and the second electrode of the driving transistor 230, the first electrode of the tenth transistor M10 is electrically connected to the second terminal of the threshold compensation unit 250, the second electrode of the tenth transistor M10 is electrically connected to the second electrode of the driving transistor 230, and the control terminal of the tenth transistor M10 is electrically connected to the fifth scan signal terminal S5, as shown in FIGS. 16 and 18.

Figure 19:
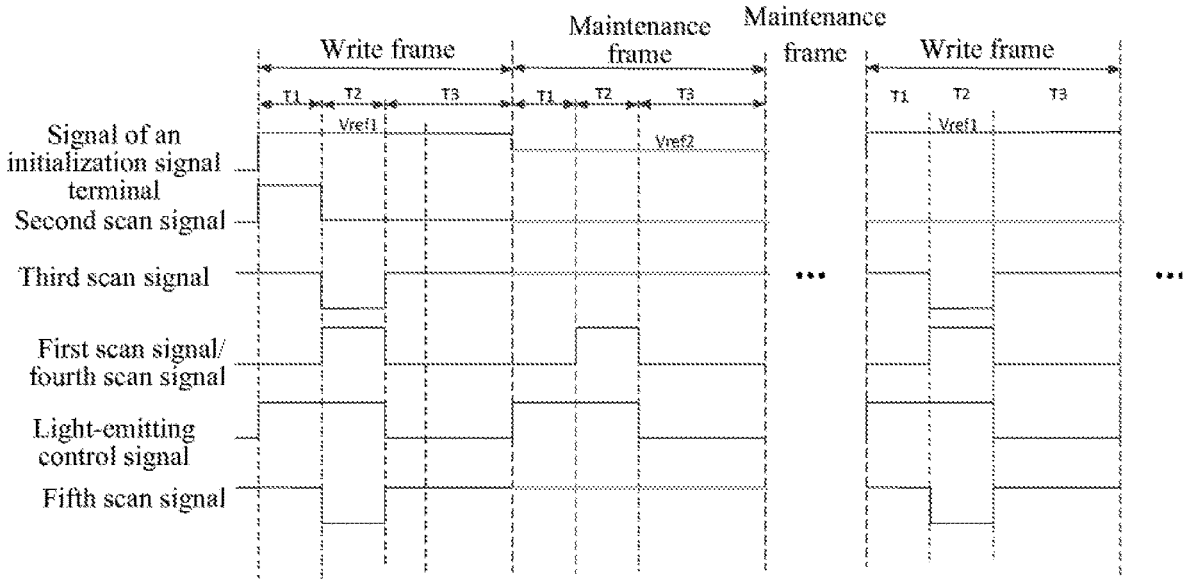
FIG. 19 is a driving timing diagram of a display panel according to an embodiment of the present application.

FIG. 19 is a driving timing diagram of a display panel according to an embodiment of the present application. With reference to FIG. 19, in the write frame, the time period in which the initialization signal terminal Vref continuously receives the first initialization voltage signal Vref1 at least overlaps a time period corresponding to a valid pulse of the fourth scan signal; and in the maintenance frame, the time period in which the initialization signal terminal Vref continuously receives the second initialization voltage signal Vref2 at least overlaps the time period corresponding to the valid pulse of the fourth scan signal.

With continued references to FIGS. 16 to 18, in an embodiment, the transistor in the threshold compensation unit 250 is an N-type transistor, and the transistor in the data writing unit 240 is a P-type transistor; or the transistor in the threshold compensation unit 250 is a P-type transistor, and the transistor in the data writing unit 240 is an N-type transistor. The transistor in the second switch unit 291 and the transistor in the data writing unit 240 are of the same type. The third scan signal is multiplexed as the fifth scan signal. In this way, circuits for generating the fifth scan signal may not be required, thereby reducing the design difficulty of the display panel.

In an embodiment, the sixth transistor M6 is an N-type transistor, and the tenth transistor M10 and the fifth transistor M5 are P-type transistors, as shown in FIG. 16; or the sixth transistor M6 is a P-type transistor, and the tenth transistor M10 and the fifth transistor M5 are N-type transistors, as shown in FIGS. 17 and 18.

Figure 20:
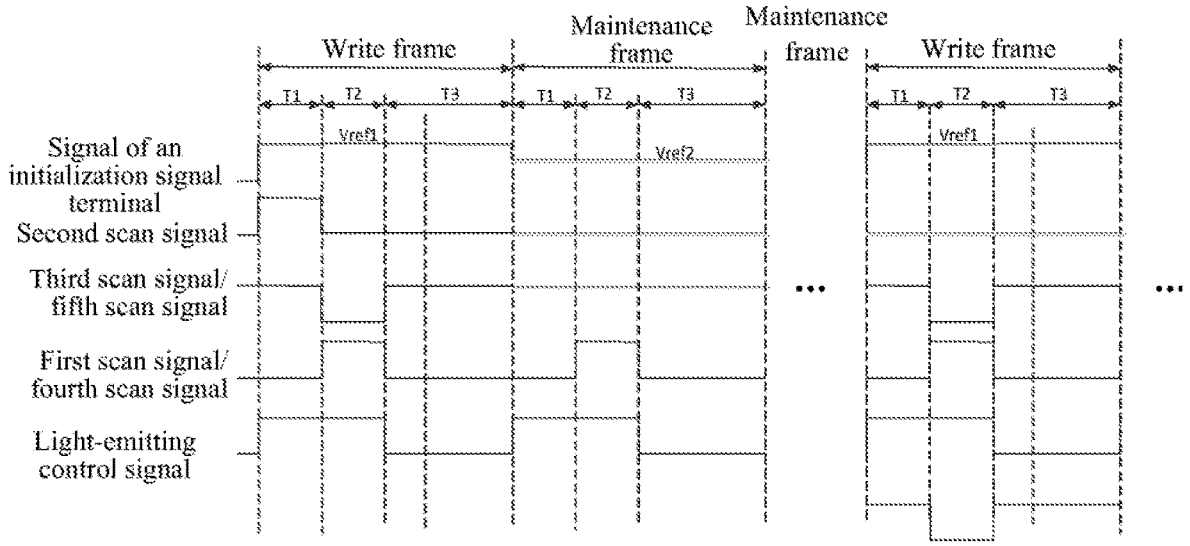
FIG. 20 is a driving timing diagram of a display panel according to another embodiment of the present application.
Figure 21:
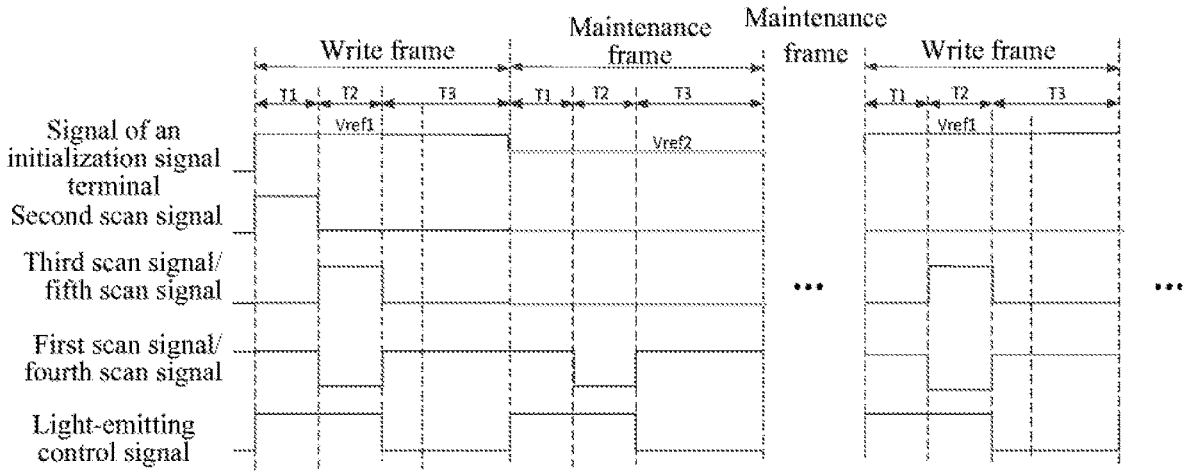
FIG. 21 is a driving timing diagram of a display panel according to another embodiment of the present application.

FIG. 20 is a driving timing diagram of a display panel according to another embodiment of the present application. FIG. 21 is a driving timing diagram of a display panel according to another embodiment of the present application. The driving timings shown in FIGS. 19 and 20 correspond to a display panel including the pixel driving circuit 20 shown in FIG. 16, and the driving timing shown in FIG. 21 corresponds to a display panel including the pixel driving circuits 20 shown in FIGS. 17 and 18.

In the driving timings shown in FIGS. 19 to 21, the operation process of the pixel driving circuit 20 is as follows. At the initialization stage T1 of the write frame, the second initialization unit 260 is turned on, and the second initialization unit 260 provides the second node N2 with the first initialization voltage signal Vref1. At the data writing stage T2 of the write frame, the first initialization unit 210 is turned on, the first initialization unit 210 provides the anode of the light-emitting element 10 with the first initialization voltage signal Vref1, and at the same time, the data writing unit 240, the second switch unit 291 and the threshold compensation unit 250 are turned on, and the data voltage signal of the data signal terminal Vdata is written into the second node N2 through the data writing unit 240, the driving transistor 230, the second switch unit 291 and the threshold compensation unit 250 sequentially. At the light-emitting stage T3 of the write frame, the first light-emitting control unit 220 and the second light-emitting control unit 270 are turned on, the driving current generated by the driving transistor 230 flows into the light-emitting element 10, and the light-emitting element 10 emits light in response to the driving current. At the initialization stage T1 of the maintenance frame, there is no operation. At the data writing stage T2 of the maintenance frame, the first initialization unit 210 is turned on, the first initialization unit 210 provides the anode of the light-emitting element 10 with the second initialization voltage signal Vref2, and at the same time, the threshold compensation unit 250 is turned on, the second switch unit 291 is turned off, and the second electrode of the driving transistor 230 and the second node N2 remain in the off state. At the light-emitting stage T3 of the maintenance frame, the first light-emitting control unit 220 and the second light-emitting control unit 270 are turned on, the driving current generated by the driving transistor 230 flows into the light-emitting element 10, and the light-emitting element 10 emits light in response to the driving current.

In an embodiment, a transistor, which is directly connected to the second node N2 and is one of the transistor in the threshold compensation unit 250 and the transistor in the second switch unit 291, is an indium-gallium-zinc-oxide transistor.

In an embodiment, when the pixel driving circuit includes one second switch unit 291 and the second switch unit 291 is electrically connected between the second terminal of the threshold compensation unit 250 and the second electrode of the driving transistor 230, the tenth transistor M10 may be a low-temperature polysilicon transistor, and the sixth transistor M6 may be an indium-gallium-zinc-oxide transistor, as shown in FIG. 16. When the pixel driving circuit includes one second switch unit 291 and the second switch unit 291 is electrically connected between the first terminal of the threshold compensation unit 250 and the second node N2, the tenth transistor M10 may be an indium-gallium-zinc-oxide transistor, and the sixth transistor M6 may be a low-temperature polysilicon transistor, as shown in FIG. 17. When the pixel driving circuit includes multiple second switch units 291 and at least one second switch unit 291 is electrically connected between the first terminal of the threshold compensation unit 250 and the second node N2, the tenth transistor M10 may be an indium-gallium-zinc-oxide transistor, and the sixth transistor M6 may be a low-temperature polysilicon transistor, as shown in FIG. 18.

It is understood that the indium gallium zinc oxide is a kind of semiconductor oxide. The leakage current of the indium-gallium-zinc-oxide transistor is relatively small, which is beneficial to stabilizing the voltage of the second node N2, thereby stabilizing the driving current generated by the driving transistor 230 and improving the uniformity of the luminance of the light-emitting element 10.

It is understood that the timings examples illustrated in FIGS. 19 and 20 correspond to the case in which the fourth transistor M4, the fifth transistor M5, the eighth transistor M8, the tenth transistor M10 and the driving transistor 230 are P-type transistors, and the third transistor M3, the sixth transistor M6 and the seventh transistor M7 are N-type transistors. The timing examples illustrated in FIG. 21 corresponds to the case in which the third transistor M3, the fourth transistor M4, the sixth transistor M6, the eighth transistor M8 and the driving transistor 230 are P-type transistors, and the fifth transistor M5, the seventh transistor M7 and the tenth transistor M10 are N-type transistors. However, the present application is not limited thereto. The type of each transistor in the pixel driving circuit 20 is not limited to the embodiments shown and described herein.

It is also understood that the driving timing diagrams as shown in FIGS. 9, 10, 11, 14, 19, 20 and 21 are the driving timings of one pixel driving circuit in the display panel, and the driving timings of pixel driving circuits in other rows are similar to this, and those skilled in the art can adaptively understand the above based on the idea of progressive scanning.

Based on the concepts described above, an embodiment of the present application further provides a display device. The display device includes the display panel described in any of the embodiments of the present application described herein. Therefore, the display device has the beneficial effects of the display panel provided by the embodiments of the present application, and is thus not repeated.

Figure 22:
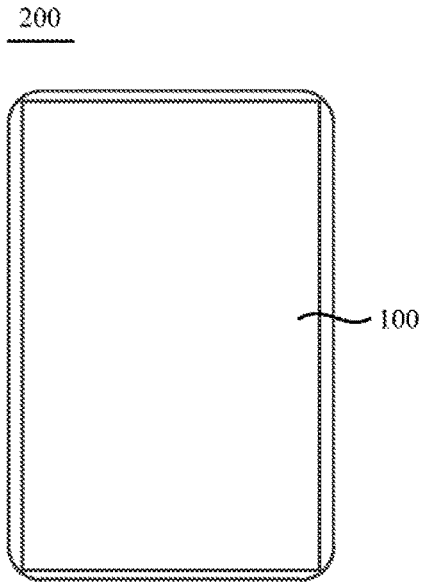
FIG. 22 is a schematic diagram of a display device according to an embodiment of the present application.

Exemplary FIG. 22 is a schematic diagram of a display device according to an embodiment of the present application. As shown in FIG. 22, the display device 200 provided by this embodiment of the present application includes the display panel 100 provided by the embodiments of the present application. The display device 200, for example, may be a touch display screen, a mobile phone, a tablet, a laptop, a television or any electronic device having a display function.

Figure 23:
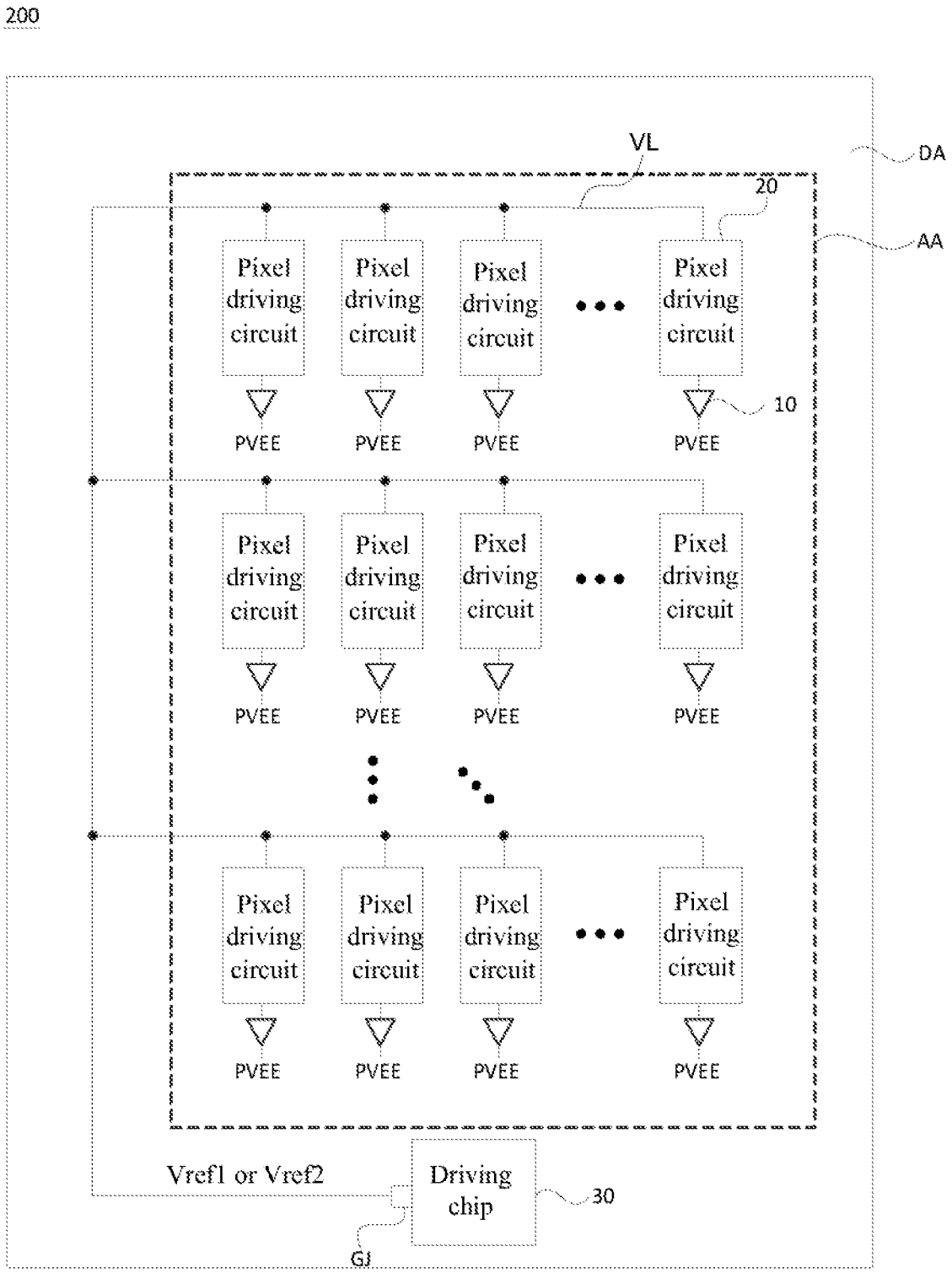
FIG. 23 is a schematic diagram of a display device according to another embodiment of the present application.

FIG. 23 is a schematic diagram of a display device according to another embodiment of the present application. With reference to FIG. 23, the display device further includes a driving chip 30. The driving chip 30 includes an initialization signal output pin GJ. The initialization signal output pin GJ is configured to output the first initialization voltage signal Vref1 in the write frame, and output the second initialization voltage signal Vref2 in the maintenance frame.

In an embodiment, the display panel further includes an initialization signal line VL. The initialization signal output pin GJ of the driving chip 30 is electrically connected to the initialization signal terminal Vref of each pixel driving circuit 20 through the initialization signal line VL. With continued reference to FIG. 23, in the whole write frame, an initialization voltage signal transmitted on the initialization signal line VL is the first initialization voltage signal Vref1, and in the whole maintenance frame, an initialization voltage signal transmitted on the initialization signal line VL is the second initialization voltage signal Vref2.

It is understood that the driving chip 30 is set to include the initialization signal output pin GJ electrically connected to the initialization signal terminal Vref of each pixel driving circuit 20, such that one pin of the driving chip can be reserved for outputting the initialization voltage signal (the first initialization voltage signal Vref1 or the second initialization voltage signal Vref2), thereby reducing the use of pin resources of the driving chip and reducing the design difficulty of the driving chip. This is also beneficial to reducing the space required for the initialization signal line VL to be routed in the non-display area DA, achieving the narrow frame and increasing the screen-to-body ratio.

Figure 24:
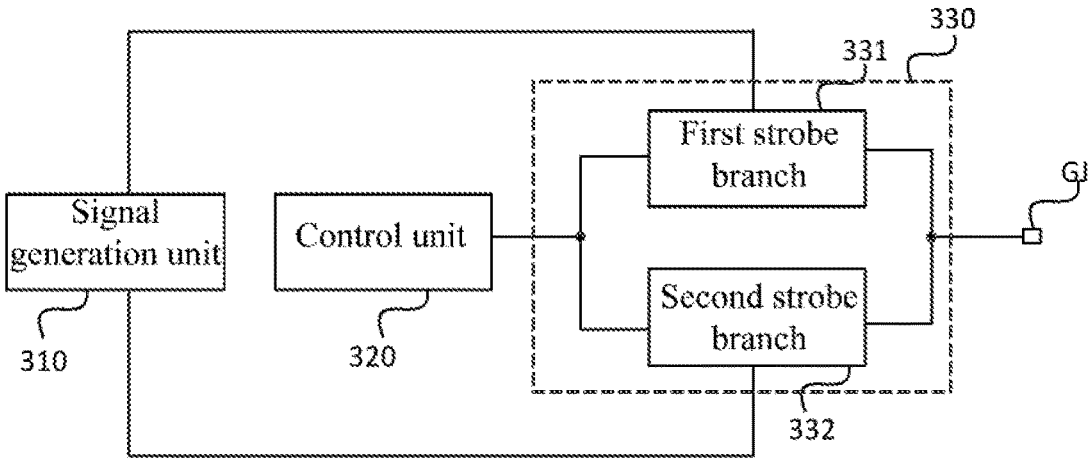
FIG. 24 is a schematic diagram of a driving chip according to an embodiment of the present application.

FIG. 24 is a schematic diagram of a driving chip according to an embodiment of the present application. With reference to FIG. 24, the driving chip includes a signal generation unit 310, a strobe unit 330 and a control unit 320. The signal generation unit 310 includes a first output terminal and a second output terminal. The first output terminal is configured to output the first initialization voltage signal Vref1, and the second output terminal is configured to output the second initialization voltage signal Vref2. The control unit 320 is configured to output a strobe signal. The strobe unit 330 includes a first strobe branch 331 and a second strobe branch 332. The first strobe branch 331 is electrically connected between the first output terminal and the initialization signal output pin GJ, and in the write frame, the first strobe branch 331 is configured to be conducted under the control of the strobe signal such that the first initialization voltage signal Vref1 is transmitted to the initialization signal output pin GJ. The second strobe branch 332 is electrically connected between the second output terminal and the initialization signal output pin GJ, and in the maintenance frame, the second strobe branch 332 is configured to be conducted under the control of the strobe signal such that the second initialization voltage signal Vref2 is transmitted to the initialization signal output pin GJ.

In an embodiment, the specific implementation forms of the signal generation unit 310 and the control unit 320 can be set according to the desired specifications. The first strobe branch 331 and the second strobe branch 332 are conducted under the control of the same strobe signal in a time-division manner, so as to output the first initialization voltage signal Vref1 and the second initialization voltage signal Vref2 to the initialization signal output pin GJ in a time-division manner. It can be understood that the first strobe branch 331 and the second strobe branch 332 are set to be controlled by the same strobe signal, which is beneficial to reducing the number of control units 320 in the driving chip and reducing the design difficulty and costs of the driving chip.

It is understood that the specific implementation forms of the first strobe branch 331 and the second strobe branch 332 can be set by those skilled in the art according to desired specifications.

Figure 25:
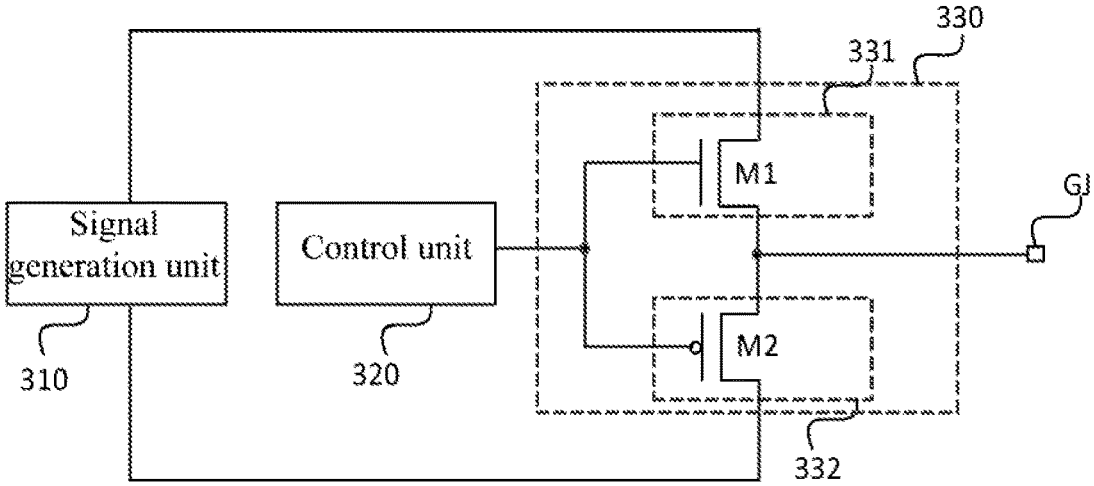
FIG. 25 is a schematic diagram of a driving chip according to another embodiment of the present application.

FIG. 25 is a schematic diagram of a driving chip according to another embodiment of the present application. With reference to FIG. 25, in an embodiment, the first strobe branch 331 includes a first transistor M1, and the second strobe branch 332 includes a second transistor M2. The first transistor M1 is a P-type transistor, and the second transistor M2 is an N-type transistor; or the first transistor M1 is an N-type transistor, and the second transistor M2 is a P-type transistor.

In an embodiment, the control unit 320 includes an output terminal for outputting the strobe signal, and a control terminal of the first transistor M1 and a control terminal of the second transistor M2 are electrically connected to the output terminal of the control unit 320. When the first transistor M1 is an N-type transistor and the second transistor M2 is a P-type transistor (as shown in FIG. 25), the first transistor M1 is turned on when the strobe signal is at a high level, and the second transistor M2 is turned on when the strobe signal is at a low level. When the first transistor M1 is a P-type transistor and the second transistor M2 is an N-type transistor, the first transistor M1 is turned on when the strobe signal is at a low level, and the second transistor M2 is turned on when the strobe signal is at a high level.

It is understood that the strobe unit 330 is set to include two transistors such that the structure of the strobe unit 330 is simple, which is beneficial to reducing the space occupied by the strobe unit and achieving the miniaturization of the driving chip.

Figure 26:
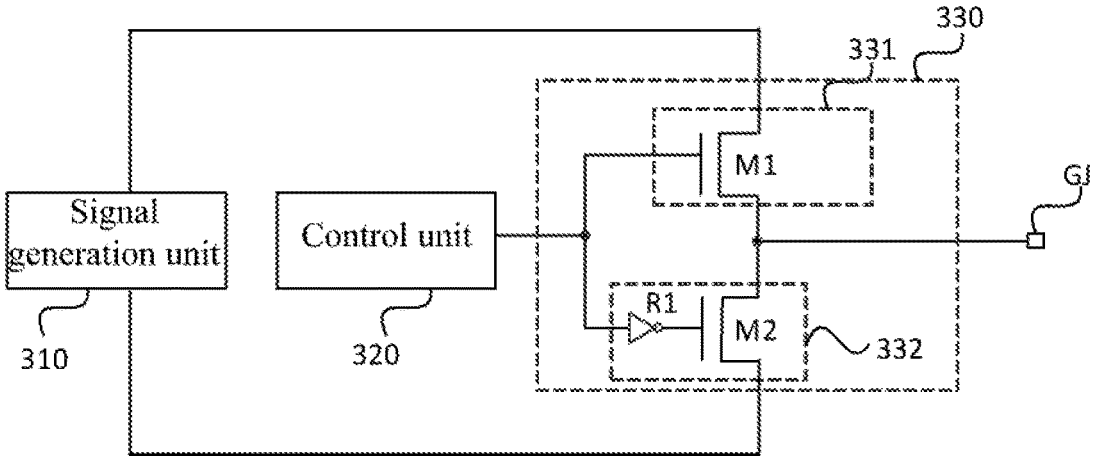
FIG. 26 is a schematic diagram of a driving chip according to another embodiment of the present application.

FIG. 26 is a schematic diagram of a driving chip according to another embodiment of the present application. With reference to FIG. 26, the first strobe branch 331 includes a first transistor M1, and the second strobe branch 332 includes a second transistor M2 and a first inverter R1. The first transistor M1 and the second transistor M2 are of the same type.

In an embodiment, a control terminal of the first transistor M1 and a control terminal of the second transistor M2 are electrically connected to the output terminal of the control unit 320. When the first transistor M1 and the second transistor M2 are N-type transistors (as shown in FIG. 26), the first strobe branch 331 is conducted when the strobe signal is at a high level, and the second strobe branch 332 is conducted when the strobe signal is at a low level. When the first transistor M1 and the second transistor M2 are P-type transistors, the first strobe branch 331 is conducted when the strobe signal is at a low level, and the second strobe branch 332 is conducted when the strobe signal is at a high level.

It is understood that the first transistor M1 and the second transistor M2 are set to be of the same type, such that both transistors can be formed by the same preparation process, which is beneficial to simplifying the preparation process of the strobe unit 330, thereby improving the preparation efficiency of the driving chip and reducing the costs.

It is understood that in the present application, the specific implementations of the P-type transistor and the N-type transistor can be set by those skilled in the art according to practical situations. For example, the P-type transistor may include a low-temperature polysilicon transistor, and the N-type transistor may include an indium-gallium-zinc-oxide transistor.

Figure 27:
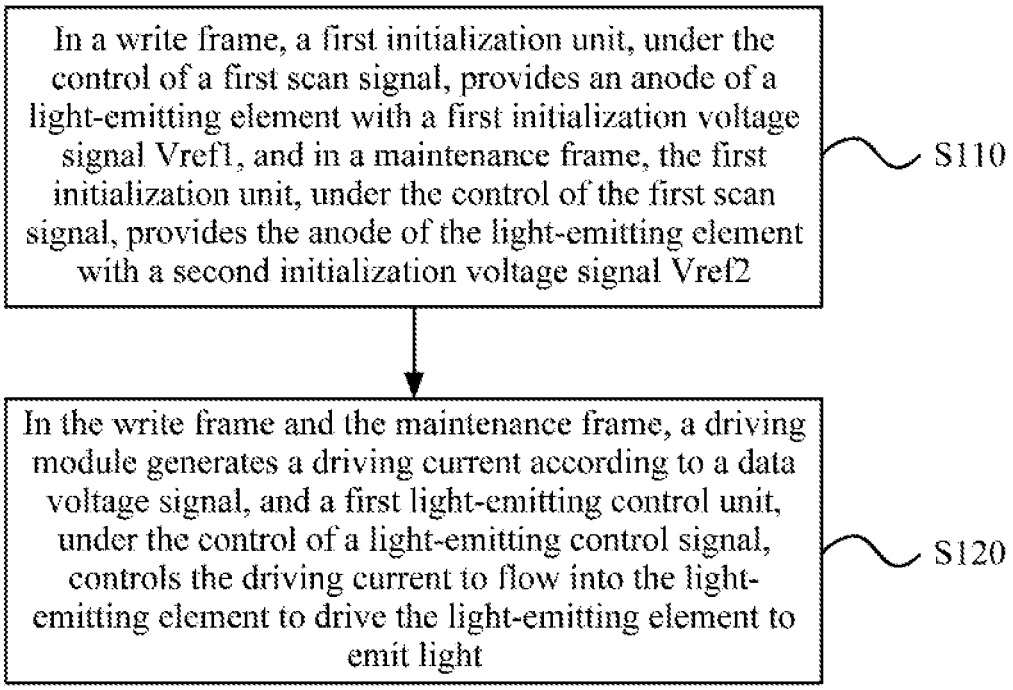
FIG. 27 is a flowchart of a driving method of a display panel according to an embodiment of the present application.

Based on the descriptions provided above, an embodiment of the present application further provides a driving method of a display panel. The driving method is applicable to the display panel described with reference to any of the embodiments of the present application. FIG. 27 is a flowchart of a driving method of a display panel according to an embodiment of the present application. With reference to FIG. 27, the driving method includes steps described below.

At S110, in the write frame, the first initialization unit, under the control of the first scan signal, provides the anode of the light-emitting element with the first initialization voltage signal Vref1, and in the maintenance frame, the first initialization unit, under the control of the first scan signal, provides the anode of the light-emitting element with the second initialization voltage signal Vref2.

At S120, in the write frame and the maintenance frame, the driving module generates the driving current according to the data voltage signal, and the first light-emitting control unit, under the control of the light-emitting control signal, controls the driving current to flow into the light-emitting element to drive the light-emitting element to emit light.

In this embodiment of the present application, different initialization voltage signals are written into the anode of the light-emitting element in the write frame and the maintenance frame, such that the time required for the voltage of the anode of the light-emitting element to become a gray-level voltage (the magnitude of the gray-level voltage is related to the magnitude of the data voltage) is different at the initial light-emitting moment of the write frame and the initial light-emitting moment of the maintenance frame, so as to compensate for the difference of the time required for the voltage of the first node to become the gray-level voltage at the initial light-emitting moment of the write frame and the initial light-emitting moment of the maintenance frame. Therefore, finally, at the initial light-emitting moment of the write frame and the initial light-emitting moment of the maintenance frame, the total time for the voltage of the first node to become the gray-level voltage and the total time for the voltage of the anode of the light-emitting element to become the gray-level voltage are approximate or even the same, thereby reducing the brightness difference between the write frame and the maintenance frame, ameliorating the issue of large brightness difference between the write frame and the maintenance frame, and achieving the effect of ameliorating the flicker and improving the display quality.

On the basis of the above technical scheme, in an embodiment, in the write frame, the voltage of the first node at an initial light-emitting moment is V1, and in the maintenance frame, the voltage of the first node at an initial light-emitting moment is V2, where $(V1-V2)*(Vref2-Vref1)>0$.

In an embodiment, with continued reference to FIGS. 4 and 5, the pixel driving circuit 20 includes the first power supply signal terminal PVDD. The driving module DM includes the storage unit 280, the driving transistor 230, the data writing unit 240, the threshold compensation unit 250, the second initialization unit 260, and the second light-emitting control unit 270. The second initialization unit 260 is electrically connected between the initialization signal terminal Vref and the second node N2. The control terminal of the driving transistor 230 and the first terminal of the storage unit 280 are electrically connected to the second node N2. The second terminal of the storage unit 280 is electrically connected to the first power supply signal terminal PVDD. The data writing unit 240 is electrically connected between the data signal terminal Vdata and the first electrode of the driving transistor 230. The threshold compensation unit 250 is electrically connected between the second electrode of the driving transistor 230 and the second node N2. The second light-emitting control unit 270 is electrically connected between the first power supply signal terminal PVDD and the first terminal of the driving transistor 230.

The driving method further includes steps described below.

In the write frame, the second initialization unit 260, under the control of the second scan signal, provides the second node N2 with the first initialization voltage signal Vref1.

In the write frame, the data writing unit 240, under the control of the third scan signal, provides the second node N2 with the data voltage signal, and the threshold compensation unit 250, under the control of the fourth scan signal, compensates the threshold voltage of the driving transistor 230 to the second node N2.

In the write frame and the maintenance frame, the first light-emitting control unit 220 and the second light-emitting control unit 270, under the control of the light-emitting control signal, writes the first power supply voltage signal into the first electrode of the driving transistor 230.

In an embodiment, the time period corresponding to the valid pulse of the second scan signal is within the time period corresponding to the valid pulse of the first scan signal. In an embodiment, the time period corresponding to the valid pulse of the second scan signal coincides with the time period corresponding to the valid pulse of the first scan signal. In this way, it can be ensured that the second initialization unit can reset the anode of the light-emitting element in the initialization stage of the maintenance frame, and a phenomenon that the light-emitting element may emit light due to the floating of the potential of the anode of the light-emitting element in the initialization stage of the maintenance frame is avoided, thus the non-uniformity of display is avoided.

In an embodiment, the time period corresponding to the valid pulse of the first scan signal coincides with the time period corresponding to the invalid pulse of the light-emitting control signal. In this way, it can be ensured that the second initialization unit can reset the anode of the light-emitting element at the initialization stage and data writing stage of the maintenance frame, that is, the voltage of the anode of the light-emitting element is a voltage value corresponding to the second initialization voltage signal at the initialization stage and data writing stage of the maintenance frame, such that it is determined that the light-emitting element does not emit light at the initialization stage and data writing stage of the maintenance frame.

In an embodiment, the transistor in the first initialization unit 210 is an N-type transistor, and the transistor in the light-emitting control unit is a P-type transistor, as shown in FIG. 7; or the transistor in the first initialization unit 210 is a P-type transistor, and the transistor in the light-emitting control unit is an N-type transistor, as shown in FIG. 8; and the light-emitting control signal is multiplexed as the first scan signal, as shown in FIGS. 9 and 10.

In an embodiment, the transistor in the data writing unit 240 and the transistor in the second initialization unit 260 are of the same type, and the first scan signal is multiplexed as the third scan signal, as shown in FIG. 14.

In an embodiment, in the maintenance frame, the data writing unit 240, under the control of the third scan signal, transmits a fixed voltage signal provided by the data signal terminal Vdata to the first electrode of the driving transistor 230, where a voltage value of the fixed voltage signal is equal to a voltage value of the first power supply voltage signal.

In an embodiment, with continued reference to FIGS. 12 and 13, the pixel driving circuit 20 further includes the first switch unit 290 electrically connected between the data writing unit 240 and the data signal terminal Vdata. In the maintenance frame, the first switch unit 290 is configured to, under the control of the sixth scan signal, transmit the first power supply voltage signal to the data writing unit 240 such that the data writing unit 240, under the control of the third scan signal, provides the first electrode of the driving transistor 230 with the first power supply voltage signal.

In an embodiment, with continued reference to FIGS. 15 to 21, the transistor in the threshold compensation unit 250 and the transistor in the first initialization unit 210 are of the same type. The first scan signal is multiplexed as the fourth scan signal. The pixel driving circuit 20 further includes at least one second switch unit 291. The second switch unit 291 is electrically connected between the first terminal of the threshold compensation unit 250 and the second node N2, and/or the second switch unit 291 is electrically connected between the second terminal of the threshold compensation unit 250 and the second electrode of the driving transistor 230. In the maintenance frame, the second switch unit 291 is configured to, under the control of the fifth scan signal, prevent the second electrode of the driving transistor 230 from being conducted with the second node N2.

The driving method of the display device provided by this embodiment of the present application has the beneficial effects of the display panel provided by the embodiments of the present application, and the same content can be understood by referring to the above description and is not repeated hereinafter.

What is claimed is:

1. A display panel, comprising a pixel driving circuit and a light-emitting element, wherein the pixel driving circuit comprises an initialization signal terminal, a data signal terminal, a first initialization unit, a driving module and a first light-emitting control unit;

wherein the first initialization unit is electrically connected between the initialization signal terminal and an anode of the light-emitting element; wherein in a write frame, the first initialization unit is configured to, under control of a first scan signal, provide the anode of the light-emitting element with a first initialization voltage signal (Vref1); and wherein in a maintenance frame, the first initialization unit is configured to, under the control of the first scan signal, provide the anode of the light-emitting element with a second initialization voltage signal (Vref2) which is different from the first initialization voltage signal (Vref1);

wherein the driving module and a first terminal of the first light-emitting control unit are electrically connected to a first node, and a second terminal of the first light-emitting control unit is electrically connected to the anode of the light-emitting element; and wherein in the write frame and the maintenance frame, the first light-emitting control unit is configured to, under control of a light-emitting control signal, control a driving current generated by the driving module to flow into the light-emitting element;

wherein a time period corresponding to a valid pulse of the first scan signal is within a time period corresponding to an invalid pulse of the light-emitting control signal; and wherein in the write frame, the driving module is configured to receive a data voltage signal provided by the data signal terminal, and wherein in the maintenance frame, the driving module is configured to do not receive the data voltage signal; and wherein in the write frame, a voltage of the first node at an initial light-emitting moment is V1, and wherein in the maintenance frame, a voltage of the first node at an initial light-emitting moment is V2; and wherein $(V1-V2)*(Vref2-Vref1)>0$.

2. The display panel of claim 1, wherein the pixel driving circuit further comprises a first power supply signal terminal; and wherein the driving module comprises a storage unit, a driving transistor, a data writing unit, a threshold compensation unit, a second initialization unit, and a second light-emitting control unit; wherein the second initialization unit is electrically connected between the initialization signal terminal and a second node; and wherein in the write frame, the second initialization unit is configured to, under control of a second scan signal, provide the second node with the first initialization voltage signal (Vref1);

wherein a control terminal of the driving transistor and a first terminal of the storage unit are electrically connected to the second node; and a second terminal of the storage unit is electrically connected to the first power supply signal terminal;

wherein the data writing unit is electrically connected between the data signal terminal and a first electrode of the driving transistor; wherein the threshold compensation unit is electrically connected between a second electrode of the driving transistor and the second node; and wherein in the write frame, the data writing unit is configured to, under control of a third scan signal, provide the second node with the data voltage signal, and wherein the threshold compensation unit is configured to, under control of a fourth scan signal, compensate a threshold voltage of the driving transistor to the second node; and wherein the second light-emitting control unit is electrically connected between the first power supply signal terminal and the first electrode of the driving transistor; and wherein in the write frame and the maintenance frame, the second light-emitting control unit is configured to, under control of the light-emitting control signal, write a first power supply voltage signal into the first electrode of the driving transistor.

3. The display panel of claim 2, wherein a transistor in the data writing unit and a transistor in the first initialization unit are of a same type; and the first scan signal is multiplexed as the third scan signal.

4. The display panel of claim 3, wherein in the maintenance frame, the data writing unit is configured to, under the control of the third scan signal, transmit a fixed voltage signal provided by the data signal terminal to the first electrode of the driving transistor; and wherein a voltage value of the fixed voltage signal is equal to a voltage value of the first power supply voltage signal.

5. The display panel of claim 3, wherein the pixel driving circuit further comprises a first switch unit electrically connected between the data writing unit and the first power supply signal terminal; and wherein in the maintenance frame, the first switch unit is configured to, under the control of the third scan signal, transmit the first power supply voltage signal to the data writing unit to enable the data writing unit to provide the first electrode of the driving transistor with the first power supply voltage signal under the control of the third scan signal.

6. The display panel of claim 2, wherein a transistor in the threshold compensation unit and a transistor in the first initialization unit are of a same type; and wherein the first scan signal is multiplexed as the fourth scan signal;

wherein the pixel driving circuit further comprises at least one second switch unit, wherein a second switch unit is electrically connected between a first terminal of the threshold compensation unit and the second node, and/or a second switch unit is electrically connected between a second terminal of the threshold compensation unit and the second electrode of the driving transistor; and wherein in the maintenance frame, the at least one second switch unit is configured to, under control of a fifth scan signal, prevent the second electrode of the driving transistor from being conducted with the second node.

7. The display panel of claim 6, wherein the transistor in the threshold compensation unit is an N-type transistor, and a transistor in the data writing unit is a P-type transistor; or the transistor in the threshold compensation unit is a P-type transistor, and a transistor in the data writing unit is an N-type transistor; and a transistor in the at least one second switch unit and the transistor in the data writing unit are of a same type; and the third scan signal is multiplexed as the fifth scan signal; or wherein a transistor, which is directly connected to the second node and is one of the transistor in the threshold compensation unit or a transistor in the at least one second switch unit, is an indium-gallium-zinc-oxide transistor.

8. The display panel according to claim 1, wherein a transistor in the first initialization unit is an N-type transistor, and a transistor in the first light-emitting control unit is a P-type transistor; or a transistor in the first initialization unit is a P-type transistor, and a transistor in the first light-emitting control unit is an N-type transistor; and wherein the light-emitting control signal is multiplexed as the first scan signal.

9. A driving method of a display panel, applicable to the display panel of claim 1, comprising:

in the write frame, providing, by the first initialization unit, under the control of the first scan signal, the anode of the light-emitting element with the first initialization voltage signal (Vref1); and in the maintenance frame, providing, by the first initialization unit, under the control of the first scan signal, the anode of the light-emitting element with the second initialization voltage signal (Vref2) which is different from the first initialization voltage signal (Vref1); and in the write frame and the maintenance frame, generating, by the driving module, the driving current according to the data voltage signal; and controlling, by the first light-emitting control unit, under the control of the light-emitting control signal, the driving current to flow into the light-emitting element to drive the light-emitting element to emit light;

wherein in the write frame, a voltage of the first node at an initial light-emitting moment is V1, and wherein in the maintenance frame, a voltage of the first node at an initial light-emitting moment is V2; and wherein $(V1-V2)*(Vref2-Vref1)>0$.

10. The driving method of claim 9, further comprising:

in the write frame, providing, by a second initialization unit disposed in the driving module, under control of a second scan signal, a second node with the first initialization voltage signal (Vref1), wherein the second initialization unit is electrically connected between the initialization signal terminal and the second node;

in the write frame, providing, by a data writing unit disposed in the driving module, under control of a third scan signal, the second node with the data voltage signal, and compensating, by a threshold compensation unit disposed in the driving module, under control of a fourth scan signal, a threshold voltage of a driving transistor disposed in the driving module to the second node, wherein the data writing unit is electrically connected between the data signal terminal and a first electrode of the driving transistor; and wherein the threshold compensation unit is electrically connected between a second electrode of the driving transistor and the second node; and in the write frame and the maintenance frame, writing, by a second light-emitting control unit disposed in the driving module, under the control of the light-emitting control signal, a first power supply voltage signal into the first electrode of the driving transistor;

wherein the pixel driving circuit further comprises a first power supply signal terminal; and the driving module further comprises a storage unit; wherein a control terminal of the driving transistor and a first terminal of the storage unit are electrically connected to the second node; and a second terminal of the storage unit is electrically connected to the first power supply signal terminal; and wherein the second light-emitting control unit is electrically connected between the first power supply signal terminal and the first electrode of the driving transistor.

11. The driving method of claim 10, wherein a time period corresponding to a valid pulse of the second scan signal is within the time period corresponding to the valid pulse of the first scan signal.

12. The driving method of claim 10, wherein a transistor in the data writing unit and a transistor in the second initialization unit are of a same type; and the first scan signal is multiplexed as the third scan signal;

wherein the driving method further comprises:

in the maintenance frame, transmitting, by the data writing unit, under the control of the third scan signal, a fixed voltage signal provided by the data signal terminal to the first electrode of the driving transistor;

wherein a voltage value of the fixed voltage signal is equal to a voltage value of the first power supply voltage signal.

13. The driving method of claim 10, further comprising:

in the maintenance frame, preventing, by at least one second switch unit disposed in the pixel driving circuit, under control of a fifth scan signal, the second electrode of the driving transistor from being conducted with the second node;

wherein a second switch unit is electrically connected between a first terminal of the threshold compensation unit and the second node, and/or a second switch unit is electrically connected between a second terminal of the threshold compensation unit and the second electrode of the driving transistor; and wherein a transistor in the threshold compensation unit and a transistor in the first initialization unit are of a same type; and the first scan signal is multiplexed as the fourth scan signal.

14. The driving method of claim 9, wherein the time period corresponding to the valid pulse of the first scan signal coincides with the time period corresponding to the invalid pulse of the light-emitting control signal.

15. The driving method of claim 9, wherein a transistor in the first initialization unit is an N-type transistor, and a transistor in the light-emitting control unit is a P-type transistor; or a transistor in the first initialization unit is a P-type transistor, and a transistor in the light-emitting control unit is an N-type transistor; and wherein the light-emitting control signal is multiplexed as the first scan signal.

16. A display device, comprising a display panel;

wherein the display panel comprises a pixel driving circuit and a light-emitting element, wherein the pixel driving circuit comprises an initialization signal terminal, a data signal terminal, a first initialization unit, a driving module and a first light-emitting control unit;

wherein the first initialization unit is electrically connected between the initialization signal terminal and an anode of the light-emitting element; wherein in a write frame, the first initialization unit is configured to, under control of a first scan signal, provide the anode of the light-emitting element with a first initialization voltage signal (Vref1); and wherein in a maintenance frame, the first initialization unit is configured to, under the control of the first scan signal, provide the anode of the light-emitting element with a second initialization voltage signal (Vref2) which is different from the first initialization voltage signal (Vref1);

wherein the driving module and a first terminal of the first light-emitting control unit are electrically connected to a first node, and a second terminal of the first light-emitting control unit is electrically connected to the anode of the light-emitting element; and wherein in the write frame and the maintenance frame, the first light-emitting control unit is configured to, under control of a light-emitting control signal, control a driving current generated by the driving module to flow into the light-emitting element;

wherein a time period corresponding to a valid pulse of the first scan signal is within a time period corresponding to an invalid pulse of the light-emitting control signal; and in the write frame, the driving module is configured to receive a data voltage signal provided by the data signal terminal, and in the maintenance frame, the driving module is configured to do not receive the data voltage signal;

wherein the display device further comprises a driving chip, wherein the driving chip comprises an initialization signal output pin, and the initialization signal output pin is configured to output the first initialization voltage signal (Vref1) in the write frame and output the second initialization voltage signal (Vref2) in the maintenance frame; and wherein in the write frame, a voltage of the first node at an initial light-emitting moment is V1, and wherein in the maintenance frame, a voltage of the first node at an initial light-emitting moment is V2, and wherein $(V1-V2)*(Vref-Vref1)>0$.

17. The display device of claim 16, wherein the driving chip further comprises a signal generation unit, a strobe unit and a control unit;

wherein the signal generation unit comprises a first output terminal and a second output terminal, wherein the first output terminal is configured to output the first initialization voltage signal (Vref1), and the second output terminal is configured to output the second initialization voltage signal (Vref2);

wherein the control unit is configured to output a strobe signal; and wherein the strobe unit comprises a first strobe branch and a second strobe branch; wherein the first strobe branch is electrically connected between the first output terminal and the initialization signal output pin, and wherein in the write frame, the first strobe branch is configured to be conducted under control of the strobe signal to enable the first initialization voltage signal (Vref1) to be transmitted to the initialization signal output pin; and wherein the second strobe branch is electrically connected between the second output terminal and the initialization signal output pin, and wherein in the maintenance frame, the second strobe branch is configured to be conducted under control of the strobe signal to enable the second initialization voltage signal (Vref2) to be transmitted to the initialization signal output pin.

18. The display device of claim 17, wherein the first strobe branch comprises a first transistor, and the second strobe branch comprises a second transistor; and wherein the first transistor is a P-type transistor, and the second transistor is an N-type transistor; or the first transistor is an N-type transistor, and the second transistor is a P-type transistor; or wherein the first strobe branch comprises a first transistor, and the second strobe branch comprises a second transistor and a first inverter; and wherein the first transistor and the second transistor are of a same type.

* * * * *